US010242854B2

(12) United States Patent
Rusinov et al.

(10) Patent No.: US 10,242,854 B2
(45) Date of Patent: Mar. 26, 2019

(54) FOURIER TRANSFORM MASS SPECTROMETRY

(71) Applicant: SHIMADZU CORPORATION, Kyoto (JP)

(72) Inventors: Aleksandr Rusinov, Manchester (GB); Li Ding, Manchester (GB)

(73) Assignee: SHIMADZU CORPORATION, Kyoto (JP)

( * ) Notice: Subject to any disclaimer, the term of this patent is extended or adjusted under 35 U.S.C. 154(b) by 73 days.

(21) Appl. No.: 15/524,373

(22) PCT Filed: Oct. 30, 2015

(86) PCT No.: PCT/EP2015/075278

§ 371 (c)(1),
(2) Date: May 4, 2017

(87) PCT Pub. No.: WO2016/083074

PCT Pub. Date: Jun. 2, 2016

(65) Prior Publication Data

US 2018/0277346 A1 Sep. 27, 2018

(30) Foreign Application Priority Data

Nov. 27, 2014 (GB) ..... 1421065.2

(51) Int. Cl.
*H01J 49/00* (2006.01)
*H01J 49/38* (2006.01)
*H01J 49/42* (2006.01)

(52) U.S. Cl.
CPC ..... *H01J 49/0036* (2013.01); *H01J 49/38* (2013.01); *H01J 49/4245* (2013.01)

(58) Field of Classification Search
USPC ..... 250/281, 282
See application file for complete search history.

(56) References Cited

U.S. PATENT DOCUMENTS 5,436,447 A 7/1995 Shew
6,107,627 A * 8/2000 Nakagawa ..... G01R 33/64 250/281

(Continued)

FOREIGN PATENT DOCUMENTS

CN 1689136 A 10/2005
CN 1898674 A 1/2007

(Continued)

OTHER PUBLICATIONS

Communication dated Apr. 27, 2018, from the State Intellectual Property Office of People's Republic of China in counterpart Application No. 201580062118.X.

(Continued)

*Primary Examiner* — Kiet T Nguyen
(74) *Attorney, Agent, or Firm* — Sughrue Mion, PLLC

(57) ABSTRACT

Disclosed is a method of quantification of one or more ion species, in a sample of ions, using a mass spectrometer, the method including the steps of:

obtaining a time domain data set corresponding to a signal induced by motion of the ions in the mass spectrometer;

adjusting the data set by applying an asymmetric window function thereto;

generating an absorption mode mass spectrum in the frequency domain including the step of applying a Fourier transform to the adjusted data set;

determining peak ranges for one or more peaks in the mass spectrum associated with the one or more ion species;

integrating, for each determined peak range, the spectral data within the respective peak range to generate a respective peak intensity value; and quantifying each of the one or more ion species on the basis of the respective peak intensity values.

15 Claims, 13 Drawing Sheets

(56) References Cited

U.S. PATENT DOCUMENTS

| | | | | |
|---|---|---|---|---|
| 8,395,112 | B1 | 3/2013 | Bier | |
| 2011/0240841 | A1 | 10/2011 | Lange | |
| 2016/0284530 | A1 * | 9/2016 | Green | H01J 49/0036 |

FOREIGN PATENT DOCUMENTS

| | | | |
|---|---|---|---|
| EP | 2372747 | A1 | 10/2011 |
| EP | 2779206 | A2 | 9/2014 |
| JP | 2005310610 | A | 11/2005 |
| WO | 2013/14731 | A1 | 10/2013 |
| WO | 2013/171313 | A1 | 11/2013 |

OTHER PUBLICATIONS

Y. Qi et al.; "Absorption-Mode Fourier Transform Mass Spectrometry: The Effects of Apodization and Phasing on Modified Protein Spectra"; Journal of the American Society for Mass Spectrometry, vol. 24, No. 6, Jun. 2013, p. 828-834 (14 pages total).

Communication dated May 27, 2015 from Great Britain Intellectual Property Office in application No. GB1421065.2.

Communication dated Feb. 8, 2016 from the International Searching Authority in application No. PCT/EP2015/075278.

Y. Qi et al., "Absorption-Mode: The Next Generation of Fourier Transform Mass Spectra," Analytical Chem. 2012, 84, pp. 2923-2929.

J.A. Bresson et al., "Improved Isotopic Abundance Measurements for High Resolutions Fourier Transform Ion Cyclotron Resonance Mass Spectra via Time-Domain Data Extraction," Journal of American Society for Mass Spectrometry, 1998, 9, pp. 799-804.

K.L. Goodner et al., "Quantification of Ion Abundances in Fourier Transform Ion Cyclotron Resonance Mass Spectrometry," Journal of the American Society for Mass Spectrometry, vol. 9, No. 11, Nov. 1998, pp. 1204-1212.

Y. Qi et al., "Supporting Information: Absorption-mode: The Next Generation of Fourier Transform Mass Spectra," Supporting information for publication: Analytical Chem 2012, 84, pp. 2923-2929.

A. Kaufmann et al., "Accuracy of relative isotopic abudance and mass measurements in a single-stage orbitrap mass spectrometer," Rapid Commun. Mass Spectrom. 2012, 26, pp. 1081-1090.

F. Xian et al., "Effects of Zero-Filing and Apodization on Absorption-Mode FT-ICR Mass Spectra," Presented at 59th ASMS Conference on Mass Spectrometry & Allied Topics, Denver, CO, USA, 2011. See reference (32) of publication: Anal. Chem. 2012, 84, pp. 2923-2929.

H. Pfaff., "Poster ThP540 FTMS-based isotopic simulator improves accuracy of mass and intensity measurements," American Society for Mass Spectrometry 2014 Abstracts.

Y. Qi et al., "Phase Correction of Fourier Transform Ion Cyclotron Resonance Mass Spectra Using MatLab," Journal of the American Society for Mass Spectrometry, 2011, 22, 138-147.

International Preliminary Report on Patentability dated May 30, 2017 issued by the International Bureau of WIPO in application No. PCT/EP2015/075278.

Communication dated Jun. 26, 2018 from the Japanese Patent Office in application No. 2017-528118.

* cited by examiner

FOURIER TRANSFORM MASS SPECTROMETRY

CROSS REFERENCE TO RELATED APPLICATIONS

This application is a National Stage of International Application No. PCT/EP2015/075278 filed Oct. 30, 2015, claiming priority based on British Patent Application No. 1421065.2 filed Nov. 27, 2014, the contents of all of which are incorporated herein by reference in their entirety.

FIELD OF THE INVENTION

The present invention relates to the analysis of mass spectra, in particular but not exclusively the present invention provides a method to quantify accurately ions in respective ion species of an ion sample from mass spectrum data.

BACKGROUND OF THE INVENTION

Fourier transform (FT) is a powerful tool to detect frequency of ion oscillations in ion traps, and based on this the FT mass spectrometry (FTMS) has been developed. Numerous studies have been carried out and methods have been implemented for the precise determination of oscillation frequencies and resolution improvement. For instance, calibration of frequency axis with special functions and usage of absorption mode (A-mode) of frequency spectrum have been tried.

However, to date not much attention has been paid to quantitative measurements for each peak in the spectrum. In other words, having generated a frequency (and consequently an m/z) spectrum one may want to know the actual number of ions that correspond to each peak of interest in the spectrum.

In conventional mass spectrometers, ions hit a detector thereby giving a measured signal where the number of ions can be evaluated by ion detector calibration. For example, a response function measured for certain parameters (ion energy, HV applied to parts of detector) is applied to the measured signal to get the real number of ions hit detector. Where the response function is constant the conversion of the measured signal to the real ion number is achieved simply by multiplication of a constant. There is no interference of ions of different m/z when such a detection technique is used. In other words, when two group of ions partially overlap each other when the detection occurs, the additivity is held and the peak integration of the resulting spectrum typically gives direct sum of the number of ions in each group.

However, in FTMS where detection is substantially different, artificial effects can take place. Briefly, the measurement routine includes injection of ions of different m/z values inside an ion trap where they can be trapped and perform oscillations during a relatively long time without changes (or with minor changes) of oscillation period. Oscillation period (or frequency) of ion(s) of each m/z value has its own value which can be measured by FT analysis.

As ions oscillate in the trap they pass one or more electrodes (typically referred to as pick-up electrodes) generating pulses of (image) charges on them which are measured in the time domain, and which can be referred to as a time domain signal. This time domain signal is measured over a certain acquisition time; the longer the acquisition time the better the frequency resolution of the frequency spectrum. The time domain signal is converted to a frequency domain signal in the frequency domain, for example using standard DFT (discrete Fourier Transform) algorithms. Thus, a frequency spectrum in complex values is obtained:

$$f(t) \rightarrow F(v) = Re(v) + iIm(v)$$

f(t) represents a time domain signal, Re represents the real part of the FT, Im represents the imaginary part of the FT, v is the frequency. The frequency spectrum can be plotted as Re(v), Im(v) or M(v) where $$M(v) = \sqrt{Re^2 + Im^2}$$

where M(v) is the magnitude of the FT, and is related to F(v) via phase factor:

$$F(v) = M(v)e^{i\varphi(v)},$$

where $\phi(v)$ is the phase.

In the simplest case, n ion clouds (each one having a certain m/z value, i.e. mass to charge ratio) would give n peaks on a M(v) plot for example.

In FTMS, the M(v) spectrum (magnitude mode, or M-mode, spectrum) is widely used for the mass spectrum representation. The advantages of M-mode are non-negative values of a spectrum, and it contains information from both real and imaginary part of frequency domain.

Peak intensity, which reflects respective ion species abundance in a spectrum, is typically evaluated on the basis of the amplitude of a peak of interest. This is the simplest and most straightforward way to make quantitative deductions from spectra. In other words, peak amplitude measurement is the simplest way of getting peak intensities indicative of ion abundances.

However, it is only possible to correctly quantify (quantize) the number of ions of a particular ion species in this way if peaks, e.g. adjacent peaks in the spectrum, do not perturb (interfere with) each other and if they all have an identical shape, e.g. a Gaussian or Lorentzian peak shape.

Integration of a peak in an M-mode spectrum, to obtain the area under the peak and thus a value for the peak intensity, can also be implemented as shown in "Kevin L Goodner et al. JASMS 1998, 9, 1204-1212" where detailed analysis has been performed on which window functions and fitting function are better for spectra represented in M-mode. Subsequently, peak intensity can be converted into an absolute value for the number of ions which were subject to analysis in the ion trap. This integration based method is supposed to give correct relative ion abundances especially for the case where the ions spatial spread dependent on its charge density during oscillations. However, it is proved that it doesn't work for M-mode spectra when there exist signal interferences.

In particular, it was found particularly problematic for FTMS to determine accurately the abundances of isotopes of the same ion using this technique. Typically, isotope ratios measured from mass spectra peak intensities obtained from image charge signal in an ion trap give values deviated from theoretical ones by significant amounts.

This is because of several reasons. For example, there is often interference between multiple close isotope peaks. Also, different ion clouds have respectively different decay rates with different abundances in the conditions when self-bunching may occur.

U.S. Pat. No. 5,436,447 describes a method of determining ion abundances in ICR FTMS using wavelet transforms. The wavelet transform intensity of a certain frequency peak is determined as a function of time and fitted with exponential decay in order to accurately find relative ion abundances at the starting time (end of excitation). Journal of the American Society for Mass Spectrometry, James A Bresson et al., 1998, 9, 799-804 discusses correction of isotopic abundance in FTICR mass spectra via time-domain data extraction. A peak of interest in frequency domain is isolated and reverse FT gives a time-domain signal for the individual mass-to-charge ratio. In the same manner, the relative ion abundances are given by the ratio of the obtained individual time domain signals.

However, the methods described in these prior art documents suffer from inaccuracies when adjacent peaks are located close enough to disturb true time-domain signal for an individual ion group obtained by inverse FT. Further, the accuracy of a recovered individual time-domain signal strongly depends on peak shape in the frequency domain. Extrapolation of individual time-domain signals via exponential decay can be used to account for damping of the signal as a cause of ion-gas collisions, but it does not account sufficiently for other kind of signal decays or modifications; for example self-bunching, which can prevail in UHV (ultra-high vacuum) conditions.

Also, the prior art methods described in these prior art documents suffer the drawback that additional time is required for performing FT and reverse FT operations.

An alternative prior art method is disclosed in the American Society for Mass Spectrometry 2014 Abstracts, Hans Pfaff, poster ThP540 ("FTMS-based isotopic simulator improves accuracy of mass and intensity measurements"). To identify measured isotopic pattern a search is performed using existing table patterns. A set of patterns is taken and is converted to frequency spectra and then into time-domain signal using inverse FT. These simulated time domain signals undergo a standard FFT procedure to get frequency spectra and correspondent mass spectra. The experimental isotopic pattern of interest is compared with the simulated patterns to find the best approximation which allows to attribute the pattern to a compound. The method allows to identify the compound despite the FT artefact effects which suppress amplitudes when there are several unresolved (or partially resolved) peaks. This method works under assumptions that peak shapes are identical, but this is not always true. Furthermore, this method cannot be applied for unknown isotopic pattern compounds which are not listed in databases, for example.

There are recent reports on using absorption mode (A-mode) spectra to represent the mass spectrum. The absorption mode spectrum (A-mode) is the part Re(v) of a spectrum of phase corrected F(v) dependence. A-mode was found to provide better resolution of spectra as it reveals about two times better resolution compared to M-mode without any additional information (raw data) recorded [Yulin Qi e al., JASMS 2011, 22:138-147]. Another publication (Yulin Qi et al., Anal. Chem. 2012, 84, 2923-2929) discusses the use of absorption mode Fourier transform mass spectra. Although absorption mode (A-mode) with various kind of window functions (apodization) is disclosed in these prior art documents, the aim of the research discussed in the documents is to improve the mass resolution and/or signal to noise ratio. However, the documents do not address the desire to quantify accurately the numbers of ions for any given peak, and do not consider how to achieve this in view of neighbouring peak interference and space charge interaction effects.

Accordingly, the prior art does not deliver a method of accurately determining the real ion abundances (relative values of quantitative values of ions) from the peak intensity, for example when the number of ions in the sample causes space charge interactions. In other words, the prior art does not deliver a method of accurately quantifying the number of ions in a particular ion species in an ion sample, for example when the number of ions in the sample causes space charge interactions.

In particular, the prior art methods do not provide techniques for determining the true ion abundances in a sample by measuring peak intensity of a mass spectrum (in the frequency domain) after Fourier transform of an acquired signal, which avoids the deviation from the real ion abundances associated with the respective peaks; e.g. where the peak(s) consist of multiple unresolved sub-peaks. As mentioned above, this is particularly problematic where the sub-peaks are a consequence of the presence of multiple isotopes of the same or similar ions in the measured sample.

SUMMARY OF THE INVENTION

Accordingly, in an aspect, the present invention proposes a method, preferably a computer implemented method, of quantification of one or more ion species, in a sample of ions, using a mass spectrometer, the method including the steps of: obtaining a time domain data set corresponding to a signal induced by motion of the ions in the mass spectrometer; adjusting the data set by applying an asymmetric window function thereto; generating an absorption mode mass spectrum in the frequency domain including the step of applying a Fourier transform to the adjusted data set; determining peak ranges for one or more peaks in the mass spectrum associated with the one or more ion species; integrating, for each determined peak range, the spectral data within the respective peak range to generate a respective peak intensity value; and quantifying each of the one or more ion species on the basis of the respective peak intensity values.

According to the present invention, the respective number of ions in one or more ion species can be accurately quantified.

The asymmetric window function may be selected to suppress later data relative to earlier data in the time domain data set.

The asymmetric window function may be selected to minimize negative side peaks in the absorption mode spectrum.

The asymmetric window function may include a shifted Gaussian window function or a shifted Hann window function. Shifted Gaussian or Hann window functions are respective symmetric Gaussian or Hann window functions w(i) which are applied with an argument i shifted half of number of points N in a time domain signal and stretched twice so that the middle point of the symmetric windows is located at the origin and the edge point is not moved, i.e. w(2*(i+N/2)).

The step of generating the absorption mode mass spectrum preferably includes applying a phase correction to the complex frequency spectrum using a predetermined phase-frequency relation.

The integration of the spectral data within each respective peak range preferably includes calculating the peak area within the respective peak range.

A peak range is preferably defined to be between two first zero crossing points of the spectral curve of the spectrum (with the base line level of the spectrum). Each of the two first zero crossing points preferably being located on a respective side of the respective peak.

The method may further include the step of applying a calibration function to correct each generated peak intensity value, wherein the step of quantifying each of the one or more ions is preferably performed on the basis of the corrected intensity value.

The calibration function may be obtained by performing a calibration process including the steps of: generating a series of respective calibration ion species of respectively different ion numbers; determining the number of ions in each respective calibration ion species using a particle detector; acquiring for each calibration ion species a respective time domain calibration data set corresponding to detected relative motion of the respective calibration ion species; adjusting each calibration data set by applying the asymmetric window function thereto; generating, for each calibration ion species, a respective absorption-mode mass spectrum in the frequency domain by applying a Fourier transform to the respective adjusted calibration data set; determining a peak range for each peak in the mass spectrum associated with the calibrant ion species; integrating, for each determined peak range, the spectral data within the respective peak range to generate a respective peak intensity value for each calibrant ion species; and determining the relation between the peak intensity value per ion and the peak intensity value to generate the calibration function for each calibrant species.

The acquisition step is preferably repeated for a series of respectively different acquisition times.

The calibration function for the peak preferably corresponds to the particular mass to charge ratio.

The calibration function preferably provides a value for the peak area contribution per unit ion.

The calibration process may be performed before or after the time domain data set is obtained.

The absorption mode spectrum is preferably generated by applying a pre-determined phase correction function to the time domain signal data set, the adjusted data set or to the spectrum resulting from the application of the transformation function.

The time domain data set is preferably obtained by a measurement process comprising the steps of: generating the ion sample comprising a plurality of ions; injecting the ion sample to an ion trap and controlling the ions to perform oscillating motion in the ion trap; and generating the time domain data set by detecting the image charge signals induced by the motion of ions.

The present invention may be embodied by a computer program which, when run on a computer, executes a method according to the present invention.

The present invention may be embodied by a computer readable medium having stored thereon a computer program which, when run on a computer, executes a method according to the present invention.

In an aspect, the present invention provides an ion trap mass spectrometer including: a detector (21) for detecting the motion of ions in the mass spectrometer, and for outputting a signal indicative of the motion of the ions; and a computer arranged: to obtain a time domain data set corresponding to the output signal; to adjust the data set by applying an asymmetric window function thereto; to generate an absorption mode mass spectrum in the frequency domain by applying a Fourier transform to the adjusted data set; to determine peak ranges for one or more peaks in the mass spectrum associated with the one or more ion species; to integrate, for each determined peak range, the spectral data within the respective peak range to generate a respective peak intensity value; and to quantify each of the one or more ion species on the basis of the respective peak intensity values.

The mass spectrometer may be an electrostatic ion trap mass spectrometer, for example a planar electrostatic ion trap mass spectrometer or an orbitrap type mass spectrometer. An orbitrap type mass spectrometer typically includes a radially outer barrel-like electrode, and a radially inner coaxially-arranged spindle-like electrode that traps ions radially between the electrodes in an orbital motion around the spindle-like electrode.

DETAILED DESCRIPTION AND FURTHER OPTIONAL FEATURES OF THE INVENTION

The present invention is applicable to mass spectrometers, in particular to Fourier Transform mass spectrometers. For example, the present invention is particularly suited to ion cyclotron resonance mass spectrometers such as a Fourier Transform ion cyclotron resonance (FT-ICR) mass spectrometers, ion trap mass spectrometers, electrostatic ion trap mass spectrometers, and planar or orbitrap mass spectrometers. Such mass spectrometers typically allow for multiple oscillations of ions and associated image charge detection.

Figure 1:
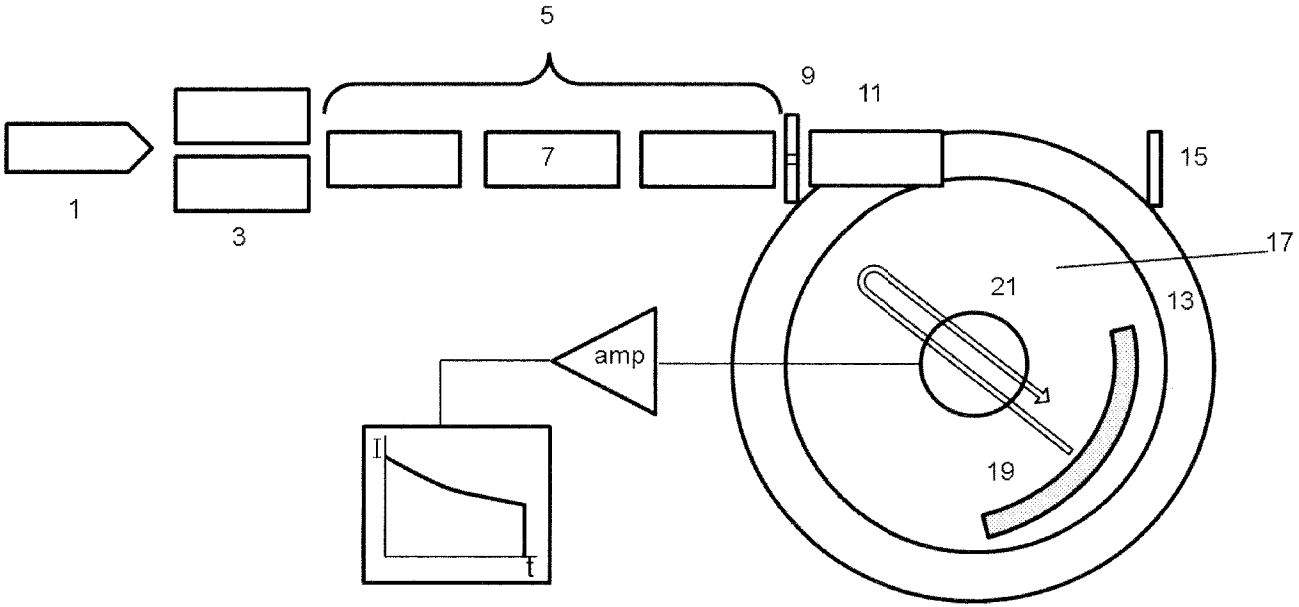
FIG. 1 shows an example of an electrostatic ion trap mass spectrometer with which the present invention may be utilized.

An example of an electrostatic ion trap mass spectrometer is presented in FIG. 1, and will be used to explain aspects of the present invention. However, the utility of the present invention is not limited to electrostatic ion trap mass spectrometers, and other types of FT mass spectrometer may be used. A general description of the operation of the mass spectrometer shown in FIG. 1 will now be given to provide a framework for the discussion of the invention.

In the mass spectrometer shown in FIG. 1, ions are typically formed from a solution in ion source 1. They are directed through a system of lenses 3 to RF quadrupole trap 5 for collisional cooling with a buffer gas inside the trapping region 7.

During cooling, a DC component can be superimposed over the RF voltage applied to quadrupole electrodes so as to isolate ions with masses corresponding to a desired m/z ratio.

After cooling and mass selection, the ions are typically ejected from region 7 through orifice 9 and are directed to travel inside ion guide 13. At a suitable time, the ions are injected into ion trap 17 typically by means of dropping the gate voltage on the radially inner side of ion guide 13.

After the ions are injected inside ion trap 17, the gate voltage is typically restored without changing total energy of the ion cloud 19.

The image charge (transient) signal may then be detected on the pick-up electrodes, one of the pick-up electrodes is shown in FIG. 1 labelled as 21.

The ion cloud oscillates during maximal detection (acquisition) time $T_{d\ max}$ allowing the transient signal to be detected. The detected transient signal is measured in the time domain.

The detected time domain transient signal is typically converted to a frequency spectrum by means of a digital Fourier Transform (and then into a mass spectrum), and the peak intensities of the peaks at the mass to charge ratios (m/z) of interest are measured in an attempt to determine the ion abundances.

The present inventors have realized that the M-mode is restricting for ion abundances evaluations because of possible interference of the separate signals forming the net signal on a pick-up electrode (detector). In general, a signal from an ion cloud oscillating in an ion trap can be presented as a sum of signals induced on the detector from each ion in the ion cloud. Linearity of the Fourier Transform allows us to represent the F(v) (frequency) spectrum of the net signal as a sum of the Fourier transform spectrum of each individual signal:

$$F_{total}(v)=M_{total}(v)e^{i\varphi_{total}(v)}=\Sigma F_i=\Sigma M_i e^{i\varphi_i}$$

In the case where the phase of each signal is the same for all ions (i.e. no spatial spread during oscillations), the final (or net) $M_{total}(v)$ spectrum (M-mode spectrum) is also sum of each individual M(v) spectrum:

$$F_{total}(v)=M_{total}(v)e^{i\varphi_{total}(v)}=\Sigma F_i=\Sigma M_i e^{i\varphi_i}=e^{i\varphi_{total}(v)}\Sigma M_i \Rightarrow M_{total}=\Sigma M_i$$

However, this assumption is not valid when ions pass the pick-up electrode at different times, i.e. when there is a spatial spread during oscillations, because the phase function at a certain v is not the same. Thus, the final (or net) $M_{total}(v)$ spectrum must account for the phase differences between the respective individual M(v) spectra, for example as follows.

$$M_{total}(v)=\sqrt{Re_{total}^2(v)+Im_{total}^2(v)}=\sqrt{(\Sigma Re_i)^2+(\Sigma Im_i)^2}\leq \Sigma\sqrt{Re_i^2(v)+Im_i^2(v)}=\Sigma M_i$$

This shows that in M-mode the resulted magnitude for each v is always smaller than the sum of individual magnitudes obtained for each ion cloud separately as it results from inequality for the modules of complex numbers. Thus, the signal interferences mean that the final (or net) $M_{total}(v)$ will not provide peak intensities which correctly reflect the true ion abundances in the sample.

Nevertheless, additivity is still maintained for both the real and imaginary parts of F(v) but not for its magnitude.

It is convenient to write down the sum of signals as $$F_{total}(v)=Re_{total}(v)+iIm_{total}(v)=\Sigma F_i=\Sigma Re_i(v)+i\Sigma Im_i(v)\Rightarrow Re_{total}=\Sigma Re_i; Im_{total}=\Sigma Im_i$$

The above equality will not be affected by multiplication of a common phase factor $e^{-i\varphi_0(v)}$, and this means that each point in absorption mode has additivity satisfied. The integration of the whole peak in absorption mode therefore also maintains the additivity regardless of whether the peak is formed by the same ions or ion with slightly different masses, or whether it is distorted by increased charge density which may substantially change the peak shape. This in turn gives a unique way to accurately determine quantitative values in FTMS.

Phase correction of the calculated F(v) is typically performed via multiplication:

$$F_{phase}(v)=F(v)e^{-i\varphi_0(v)},$$

Where $\phi_0$ (v) is a phase correction function pre-measured for a set of frequencies.

This transformation effectively rotates the complex vectors so that all the peak maxima are aligned along the real axis. The real part of $F_{phase}$ spectrum now can be plotted to give whole (full) information in the spectrum, and approximately two times better resolution compared with M-mode whilst still retaining the additivity property.

Because of the direct additivity, the present inventors have realized that the integral under a peak in A-mode can be used to determine accurately the number of corresponding ions in the trap. The peak may be constructed by several unresolved sub-peaks, so the area under the peaks may be used to represent the total number of ions within that frequency range. This is particularly important for calculation of the isotope ratio, where one isotope peak may contain several isotope fine structure lines which are not resolved even with high resolving power Fourier Transform mass spectrometry.

However, sometimes, negative overshooting of a peak in an A-mode spectrum exists. The peak intensity, for example the integral over the entire peak providing the peak area, will determine the (additive) net area value and will necessary take account of the negative overshoot. Although the integration over the peak (including negative intensity lobes, i.e. the negatively overshooting lobes) leads to absolutely correct peak intensity value, it is not desirable in case of smaller adjacent peaks as they can be completely suppressed by such negative overshooting.

The negative intensity lobes of a peak depend on the window function applied to the signal prior to the Fourier Transform which results in apodization of peaks.

Conventionally, symmetric window functions which smoothly go to zero in the beginning and the end of a signal are applied to the signal, for example full Hann or full Gaussian windows. However, such kinds of windows give substantial negative intensity lobes in A-mode spectrum, which are undesirable for at least the reason given above.

Asymmetric Window Functions

The present inventors have found asymmetric window functions to reduce the contribution of negative intensity lobes. Examples of such asymmetric windows are half Gaussian windows, or other type of dependencies, which largely do not suppress the initial part of a signal but which reduce the later part of a signal, when applied as a window function.

Therefore, where it is necessary to identify closely located peaks and determine the respective ion abundances, asymmetric windows are preferable to minimize negative overshooting, and preferably to determine the integration intervals (i.e. the peak range across which the integration under the spectral curve is performed).

The integration interval can be determined as follows:

1. Between the (first) zero crossing points of the spectral curve with the baseline level with respect to the peak position on either side of the peak. Preferably, the points are the zero crossing points on the spectral curve which are closest to the peak maximum (one on each side of the peak).
2. Between (first) points of the spectral curve, one on either side of the peak maximum, each having a (amplitude) value corresponding to a certain percentage, e.g. 5% or less, of the peak amplitude at the peak maximum. Preferably, the points are the points on the spectral curve which have the desired values and are closest to the peak maximum (one on each side of the peak maximum).

Where it is necessary to determine net ion abundance corresponding to a set of spectral peaks which cannot be mutually resolved (e.g. due to coalescence effects or fine isotopic structure of a peak) at given trapping and injection conditions—in which case the set of peaks would interfere each other—the net ion abundance is to be determined via integration of these peaks including as many negative parts of peaks as possible. Window type is not important here as additivity still holds in A mode when negative areas are included in integration.

The integration interval can be determined as an interval between the second (or higher) zero crossing points of the spectral curve with the baseline level, with respect to the peak position, on either side of the peak.

Figure 2:
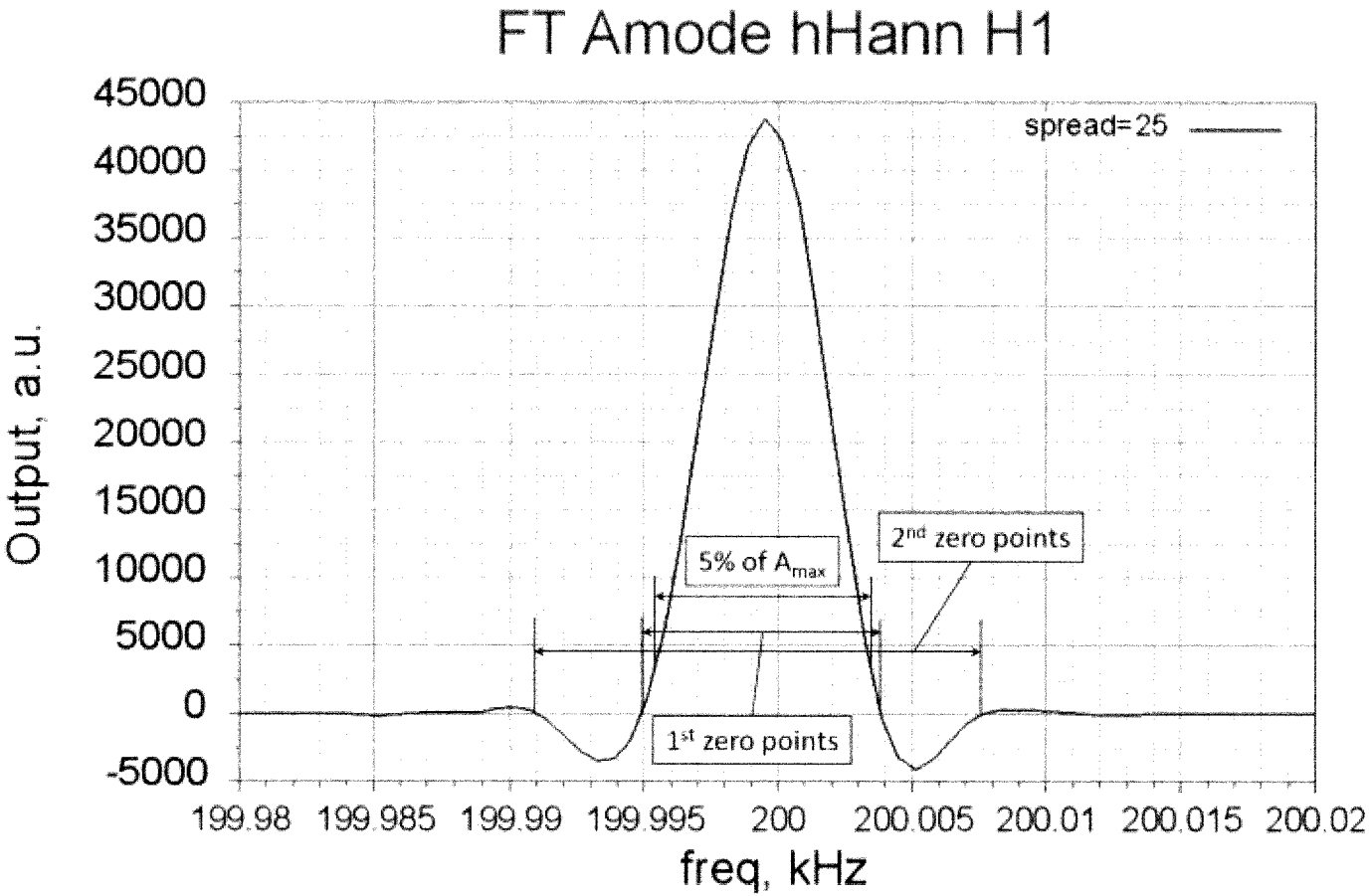
FIG. 2 shows a Fourier transform A-mode frequency spectrum generated using a half Hann window.

Examples of the integration interval choice, with respect to first and second zero crossing points, are shown in FIG. 2.

As can be seen in FIG. 2, the integration interval (or peak range) can be selected to be between any matching pair of zero crossing points on the spectral curve, each located on a respective side of the peak maximum.

For example, the interval may be defined by the first zero crossing points, which are the points on the spectral curve where the spectral curve crosses the base line level (i.e. the zero amplitude level) and which are the points satisfying this condition that are closest to the peak maximum.

In another example, the interval may be defined by the second zero crossing points, which are the points on the spectral curve where the spectral curve crosses the base line level (i.e. the zero amplitude level) and which are the points satisfying this condition that are second closest to the peak maximum. It is preferable that the subsequent positive lobes are also included in the integration, i.e. between $3^{rd}$ zero-crossing points in FIG. 2.

In another example, the interval may be defined by non-zero points on the spectral curve. For example, the points may be chosen to be points on the spectral curve having an amplitude which is a predetermined proportion of the amplitude of the peak maximum. The proportion may be expressed as a percentage, for example 5% or less.

The integration interval defines the boundary of the integration of the area under the curve, thereby providing a value for the peak intensity. Thus, in the example using the first zero points, the negative lobes (overshoot) of the spectrum are not included in the integration. Likewise, this is typically likely to be true of the non-zero points example, where the proportion is chosen to be e.g. 5%.

However, in the example where the interval is defined according to the second zero points, then the negative lobes will be included in the integration.

Preferred window function for generating an A-mode spectrum having minimal negative overshoot (minimal negative lobes) are either asymmetrical windows formed as half part of the typical symmetric (full) windows for FT like triangle (Bartlett), $\cos^n(x)$ (Hann), Hamming, Poisson, Gaussian or asymmetrical windows formed as half part of other symmetric windows.

Half windows are formed so that the respective full window maxima position is shifted to the origin (beginning of a signal) to maintain the emphasis of the beginning part of the signal (or corresponding data) to which the window is applied. And the window is typically stretched two times along time axis so that it tends to zero at the end of the signal. Any combination of the typical windows or arbitrary window function can be used so as to emphasize the beginning part of a signal and suppress the latter part of a signal.

Nevertheless, it may be desirable to use a window which suppresses a very small initial portion of the signal (typically only up to several msec) in the case where there is unwanted interference on the signal, for example due to stabilization processes in the electrical circuit aimed to transfer the signal from pick-up electrode to the data recorder.

Alternatively, windows of which the FT have minimal negative overshoot are preferable as their convolution with the signal FT likely results in less negative overshoot.

Figure 3:
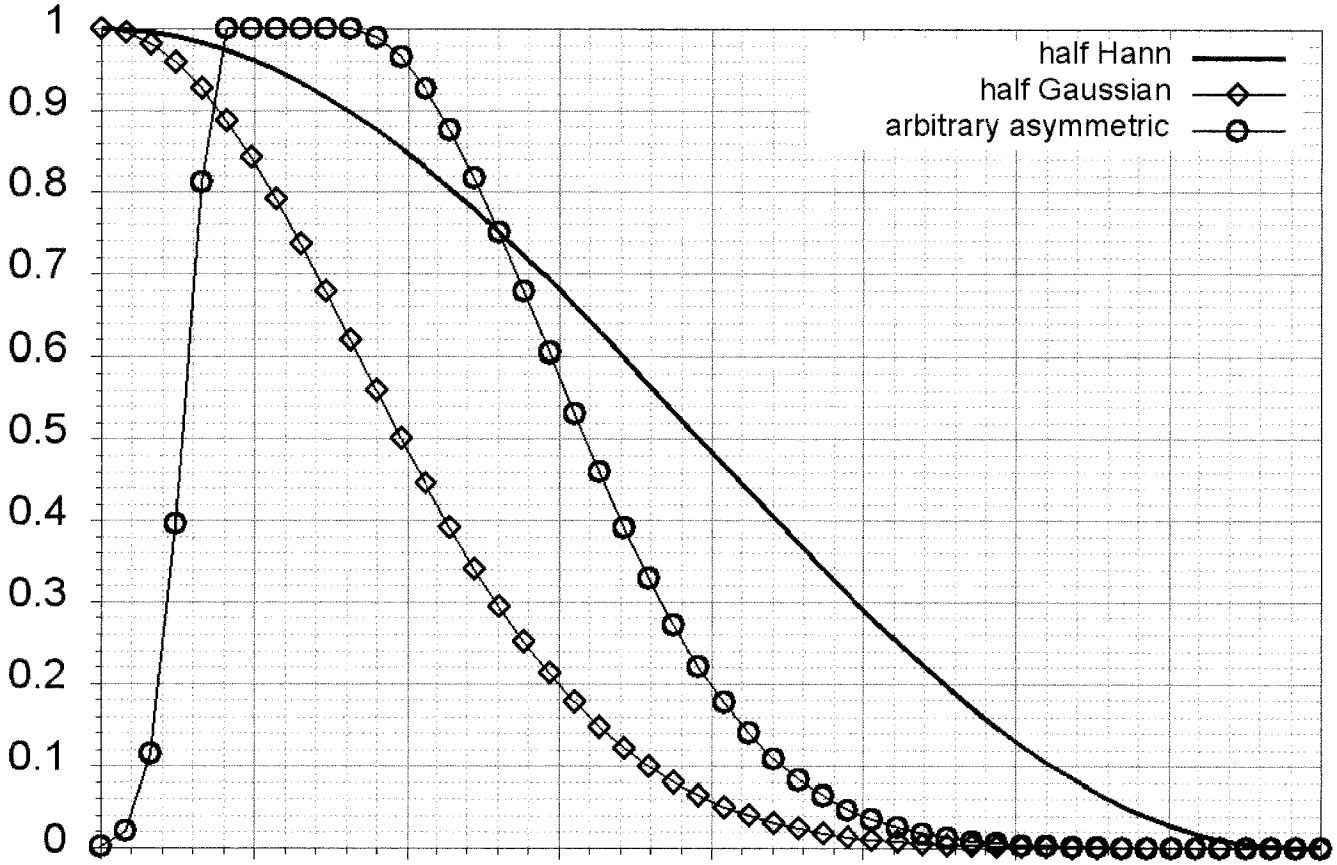
FIG. 3 shows various window functions that can be applied to time domain data prior to transformation into a mass spectrum.

Examples of preferable asymmetric window functions for use in generating the A-mode spectra according to the present invention are shown in FIG. 3, and are shown mathematically below:

$$\text{Half Hann: } w(i) = \frac{1}{2}\left(1 - \cos\left(\pi\frac{i}{N-1} + \pi\right)\right)$$

$$\text{Half Gaussian: } w(i) = \exp\left(-5\left(\frac{i}{N}\right)^2\right)$$

where N is number of data points in a time domain signal.

Phase Correction Function to Generate A-Mode Spectrum

A phase correction function is determined initially for a known ion trap field configuration and known injection conditions. A set of ion clouds with known masses is injected into the ion trap and a signal is detected during a certain acquisition time so that the number of oscillations is enough to completely resolve each peak in the spectrum. It is preferable to use the same time for this initial measurement as in the actual sample measurement later.

The recorded signal is multiplied by the same window function, preferably using the asymmetrical window function as discussed above, and a digital Fourier transform is applied to the product, for example a fast Fourier transform, to get real Re(v) and imaginary Im(v) set of numbers. Phase correction at the spectrum peak frequency $v_{peak}$ of interest is calculated using the formula $$\varphi(v_{peak})=\mathrm{arctg}(Im(v_{peak})/Re(v_{peak}))+\pi n$$

with n to be integer starting from 0 and incrementing according to the tangent function periodicity so as to provide smooth phase variation over whole frequency range under consideration (without sudden discontinuities or steps) so as to exclude phase wrapping effect. Interpolation can be used to obtain the phase correction value when the frequency sampling points skip the real peak position.

When the number of points constituting the peak is not enough to perform interpolation, zero padding is to be applied to increase the number of points. Phase angle $\phi$ and spectral amplitude M are calculated for a peak at interpolation points $v_k$ using formulas $$\varphi(v_k)=\mathrm{arctg}(Im(v_k)/Re(v_k))+\pi n$$

$$M(v_k)=\sqrt{Re^2(v_k)+Im^2(v_k)}$$

to exclude phase wrapping effect. The dependence $\phi(M)$ is plotted then and the phase angle for the phase $\phi_{max}$ for peak point $M_{max}$ can be chosen as $\phi_i(v_i)$ for each peak from the set in frequency spectrum. $\varphi_i(v_i)$ dependence can be interpolated in turn to get phase angle $\phi_0$ for correction at any desired frequency v. In order to correct a F(v) spectrum to plot the A-mode the interpolated phase dependence is used at every frequency position. The A-mode spectrum is then plotted as the real part of $F_{phase}(v)$ using formula:

$$Re_{phase}(v)=M(v)\cos(\varphi(v)-\varphi_0(v))$$

where $\phi_0(v)$ is interpolated phase correction function, $\phi(v)$ and M(v) are the phase and amplitude of original F(v) complex spectrum.

However, there is an alternative way of obtaining the absorption mode spectrum, which is especially useful for signals consisting of multiple orders of harmonic frequency of ion motion. This method is disclosed in U.S. patent application Ser. No. 13/838,357 (the entire disclosure of which is incorporated herein by reference), where Li Ding et al. disclosed a method for processing the frequency spectrum by producing a linear combination of the plurality of image charge/current signals using a plurality of predetermined coefficients. This will be explained, in summary, here for a case having 5 pick-up electrodes where each detects a time domain signal and then the signal is transformed it into the frequency domain. For each ion of a certain mass to charge ratio there may exist many harmonic frequency components in the frequency spectrum (including the fundamental frequency) and the disclosed method has the aim to eliminate those unwanted harmonic components by use of a linear combination. These coefficients which used for linear combination, can be expressed as a vector like $$X=[x_1,x_2,x_3,x_4,x_5]^T$$

and they are a group of complex numbers $x_i$.

Because X was selected to satisfy that $$CX=\begin{pmatrix} C_{11}(m/z) & C_{21}(m/z) & C_{31}(m/z) & C_{41}(m/z) & C_{51}(m/z) \\ C_{12}(m/z) & C_{22}(m/z) & C_{32}(m/z) & C_{42}(m/z) & C_{52}(m/z) \\ C_{13}(m/z) & C_{23}(m/z) & C_{33}(m/z) & C_{43}(m/z) & C_{53}(m/z) \\ C_{14}(m/z) & C_{24}(m/z) & C_{34}(m/z) & C_{44}(m/z) & C_{54}(m/z) \\ C_{15}(m/z) & C_{25}(m/z) & C_{35}(m/z) & C_{45}(m/z) & C_{55}(m/z) \end{pmatrix} X=\begin{bmatrix} l_1 \\ l_2 \\ l_3 \\ l_4 \\ l_5 \end{bmatrix},$$

where $C_{jk}(m/Z)$ stand for the complex peak value of the signal from jth detector in the frequency domain and the kth order of harmonic for ion of m/z, and only one of the $l_i$ is set for 1 while others being zero, such a linear combination results in not only elimination of harmonics other than the ith order but also vanishing of imaginary part at the ith harmonic peak. This vanishing of the imaginary part only applies to certain m/z (certain frequencies) if X is obtained through calibration using this m/z. This is to say that it gives the A-mode mass spectrum for only one mass point. However, if we use ions of multiple m/z values in the calibration, calculate X(m/z) for each m/z, and interpolate the X as a function of m/z, we can apply linear combination using the m/z dependent coefficient X to achieve global A-mode mass spectrum.

This method for obtaining the A-mode spectrum is especially useful for ion traps that generate multiple harmonics in the image charge signal, and which are capable of using a number of pick-up electrodes to generate the image charge signals. This is likely to be the case when using an electrostatic ion trap.

Demonstrative Example

The undesirable interference effects on M-mode spectra, and the additivity of A-mode spectra will be shown by means of simulated signals and their FT.

Imagine an ion cloud of 1000 ions of the same m/z passing a pick-up electrode and generating therein a time-domain signal. Initially the ion cloud is compact and focused (spatial spread is near zero), during oscillations its size gradually spreads at a constant rate (spatial spread increases).

Distance from the pick-up electrode is expressed as $$r(t)=r_0\sin(2\pi v\cdot t+\Delta\varphi_{acc}),$$

where v is the oscillation frequency, t is time, $\Delta\phi_{acc}$ is accumulated phase which is needed when the frequency is a function of time.

The pick-up electrode response is expressed as $$f(t)=f_0e^{-\beta r^2}$$

Figure 4:
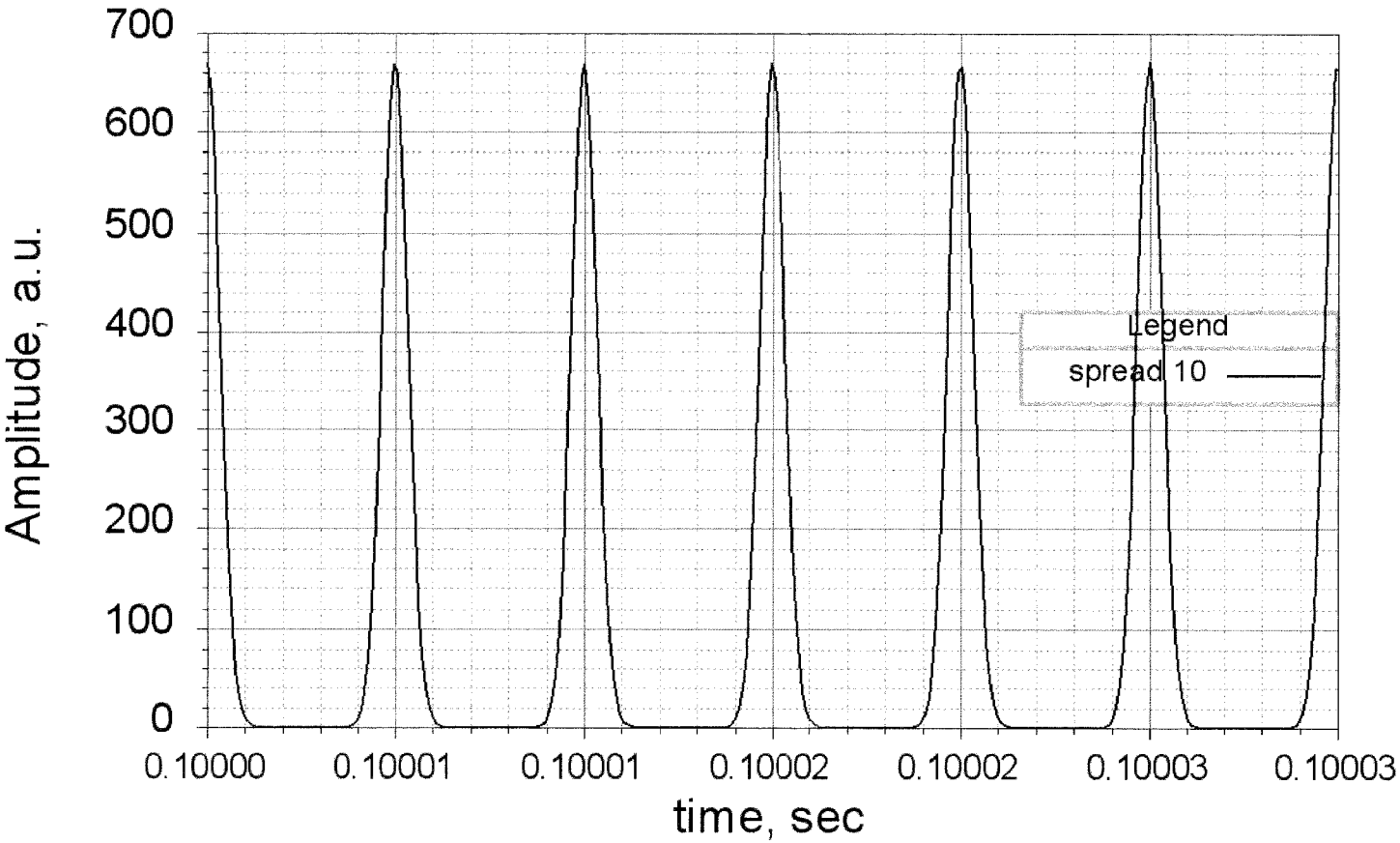
FIG. 4 shows an example time domain signal acquired from a pick-up electrode.

This model gives exponential like spikes which simulate a possible real signal when the pick-up electrode is small compared with the effective size of the trap along the oscillations direction. An example of such a time domain signal for frequency $v_0$=200 kHz and spread $\alpha$=10, and a sampling rate of 47.68 nsec is shown in FIG. 4.

The simplest case of ion cloud spatial spread can be implemented via normal frequency spread of 1000 ions in the cloud. The frequency spread is kept constant during the whole oscillation time of 0.4 sec. The standard deviation (or spread factor) of the frequencies distribution was varied to simulate faster ion cloud spatial spread, a range of spread $\alpha$=0 to $\alpha$=25 was used.

After acquiring the respective signals and converting them to the frequency domain by means of FFT with a chosen window we obtain a frequency domain spectrum (for each spread factor $\alpha$) with a number of peaks (or harmonics).

Figure 5A:
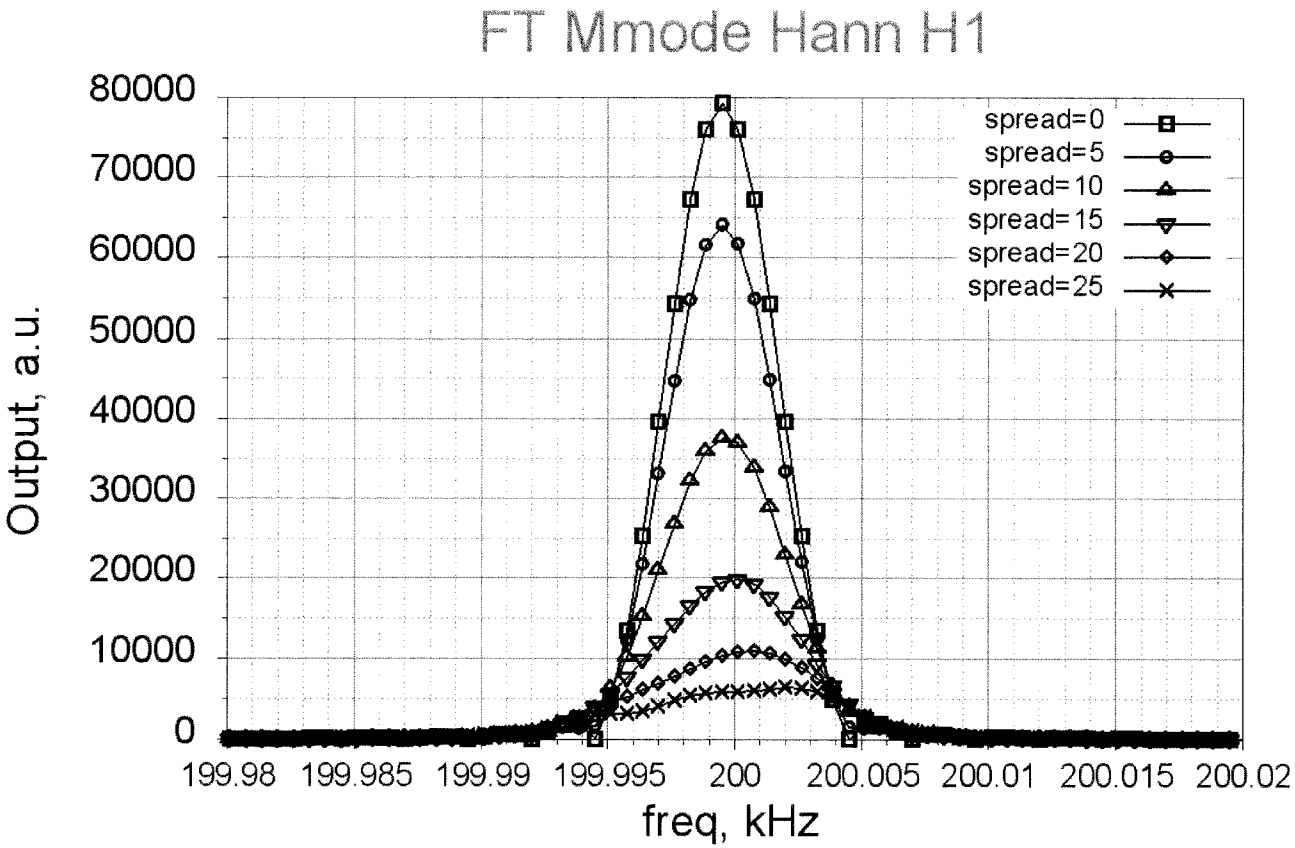
FIG. 5A shows a Fourier transform M-mode frequency spectrum generated using a full Hann window for various spread factors.
Figure 5B:
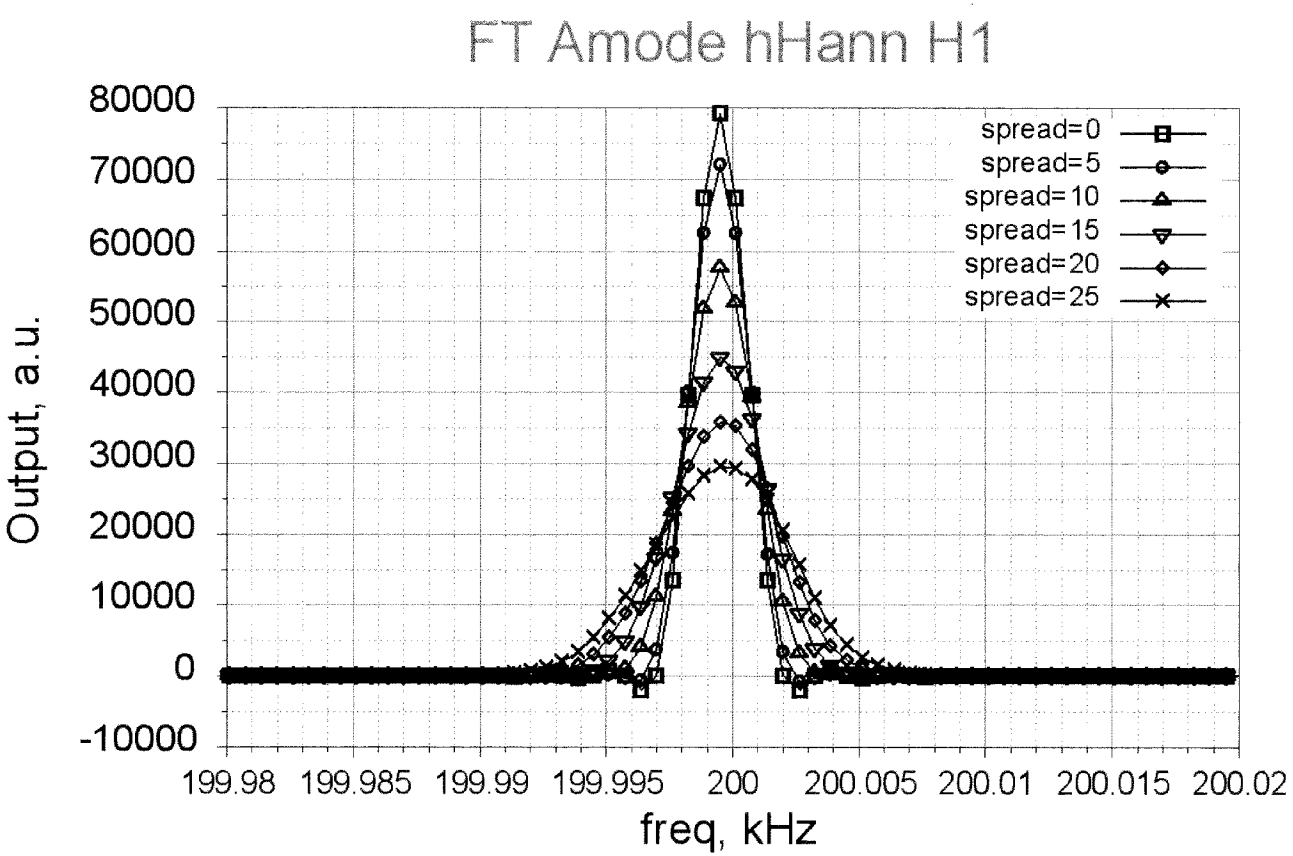
FIG. 5B shows a Fourier transform A-mode frequency spectrum generated using a half Hann window for various spread factors, in accordance with an aspect of the present invention.

The main peaks (or the first harmonics) of the spectrum generated in M-mode with (full) Hann window and in A-mode with half Hann window are shown respectively in FIGS. 5A and 5B. The main peak for each of the spread factors $\alpha$ are shown overlaid on one another, on each plot.

Figure 6:
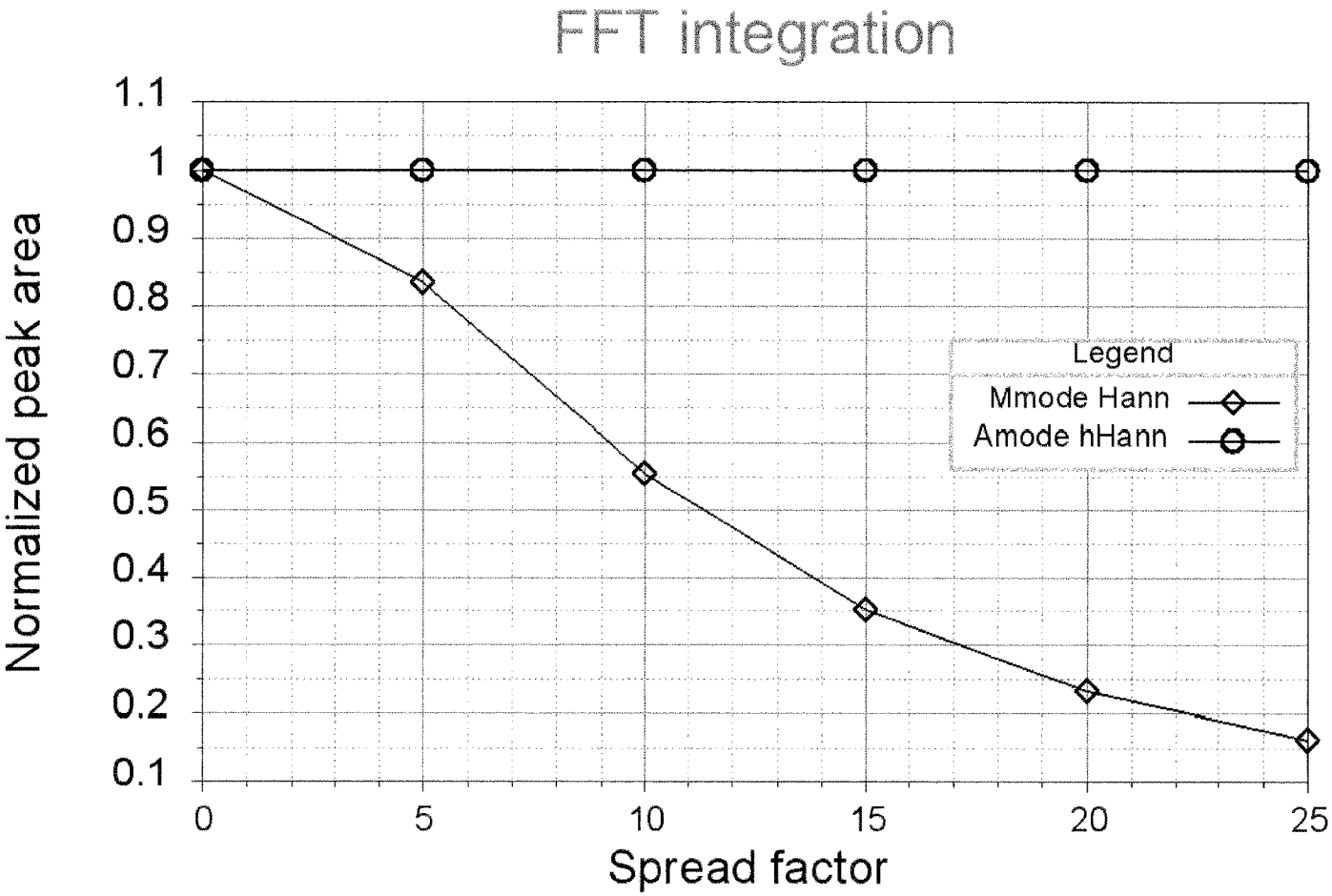
FIG. 6 shows a plot of the normalized peak area (calculated by integration) for frequency spectrum peaks corresponding to various spread factors, for (i) a Fourier transform M-mode frequency spectrum generated using a full Hann window function, and (ii) a Fourier transform A-mode frequency spectrum generated using a half Hann window.

Results of the integration of the peak for each spread factor $\alpha$ (to determine the area under the peak) within the 199.8 kHz-200.2 kHz interval are shown in FIG. 6. The calculated area is normalized to an area calculated for a peak corresponding to zero spread factor.

It is immediately seen that the normalized area of peaks for M-mode with full Hann window ("Mmode Hann") apodization is not constant relative to the calculated zero spread factor reference value, even though the number of ions is the same. The error is as large as 85% for the maximal spread factor $\alpha=25$. This is caused by the aforementioned interference phenomena.

On the other hand, according to the present invention, the A-mode with half Hann window apodization gives perfect additivity for any spread factor $\alpha$, as shown by the plot line based on the circles in FIG. 6 ("Amode hHann"). In other words, the plot shows that the normalized area of the peaks for the A-mode with half Hann window match well with the area of the area of the peak for the zero spread factor, meaning that even in the presence of the spreading phenomenon the method according to the present invention provides a peak intensity which can be used to accurately quantify the ion abundance.

This means that if we have 6 ion clouds with the same number of ions in each ion cloud but with respectively different (spatial) spreading caused by some effect, integrating under the peaks in the frequency spectrum generated in M-mode will yield a respectively different number of ions in each ion cloud, and that is incorrect. The reason for this is the nature of FT. For zero spread factor ($\alpha=0$) all the 1000 ions pass the pick-up electrode at the same time and the measured signal is sum of 1000 signals of each ion. In the zero spread factor case M(v) is also sum of 1000 FT for each individual signal because all signals are in the same phase. But, this is not true when ions pass the pick-up electrode at different times, i.e. when there is a spatial spread amongst the ions, because the phase function at a certain v is not the same anymore. Nevertheless, the additivity still holds true, but for real and imaginary parts of F(v), not for its magnitude. Thus, using the M-mode spectrum can lead to the wrong conclusions.

In the following model the frequency spread is implemented in the form of $$v_i(t)=v_0+\alpha(v_{i0}-v_0)t$$

where $v_i$ is the individual frequency of each ion taken from initial set $v_{i0}$ with a normal distribution (with the standard deviation of 1) over 1000 ions near the central frequency $v_0$, $\alpha$ is frequency spread factor (frequency spread rate). This kind of spread gives spatial spread as well and is more realistic as spatial spread of ions in a real device gives frequency spread. These simulations model one of the possible real situations of ion cloud oscillations in PEIT (planar electrostatic ion trap) where the ions' frequency oscillations spread out as the cloud spreads out in space, for instance under the conditions of soft mirror reflections.

Figure 7:
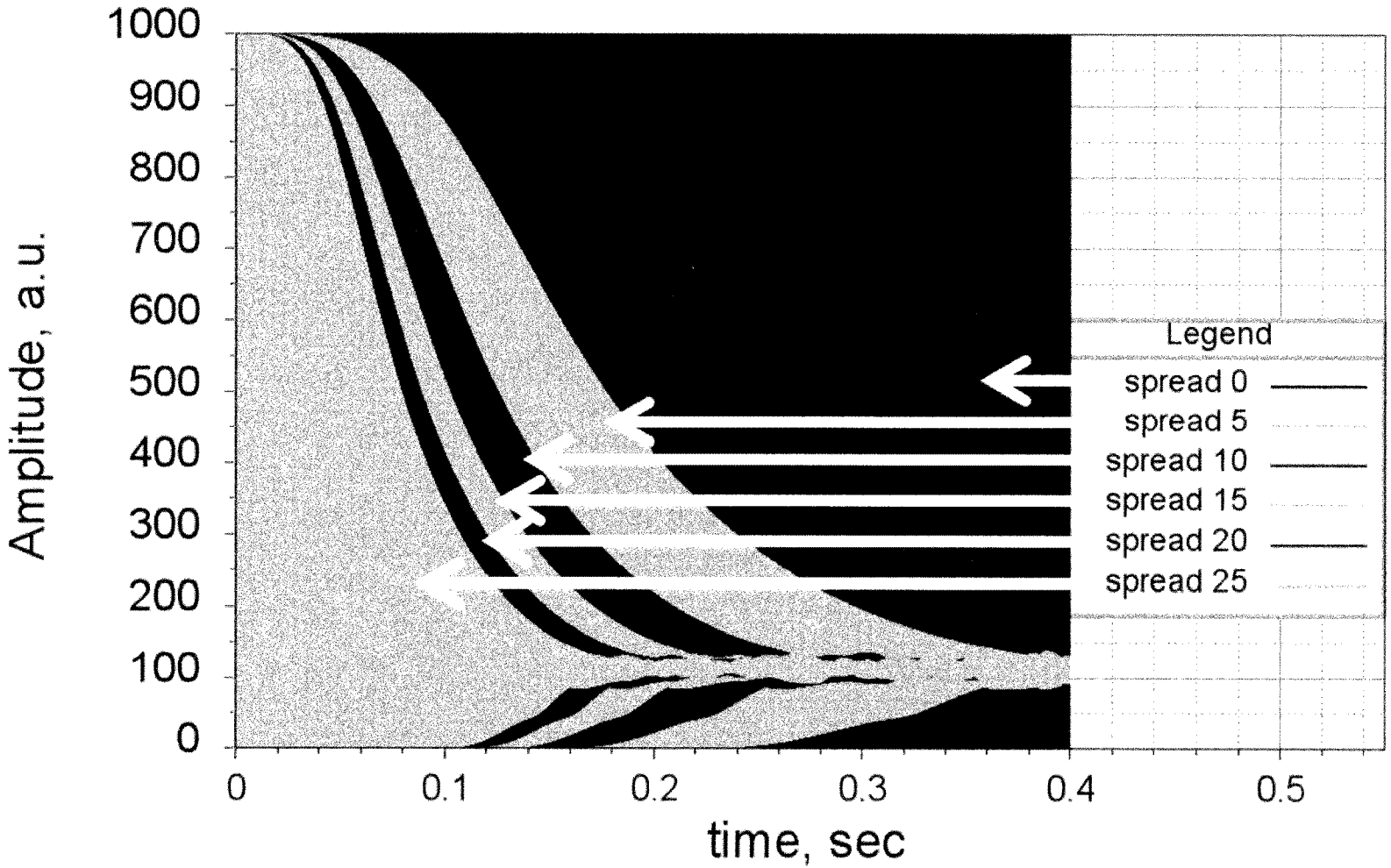
FIG. 7 shows a set of time domain signals acquired from a pick-up electrode for a range of spread factors.

FIG. 7 shows a set of time domain signals with respective spread factors $\alpha=0$ to $\alpha=25$ providing the variation of the signals.

Figure 8:
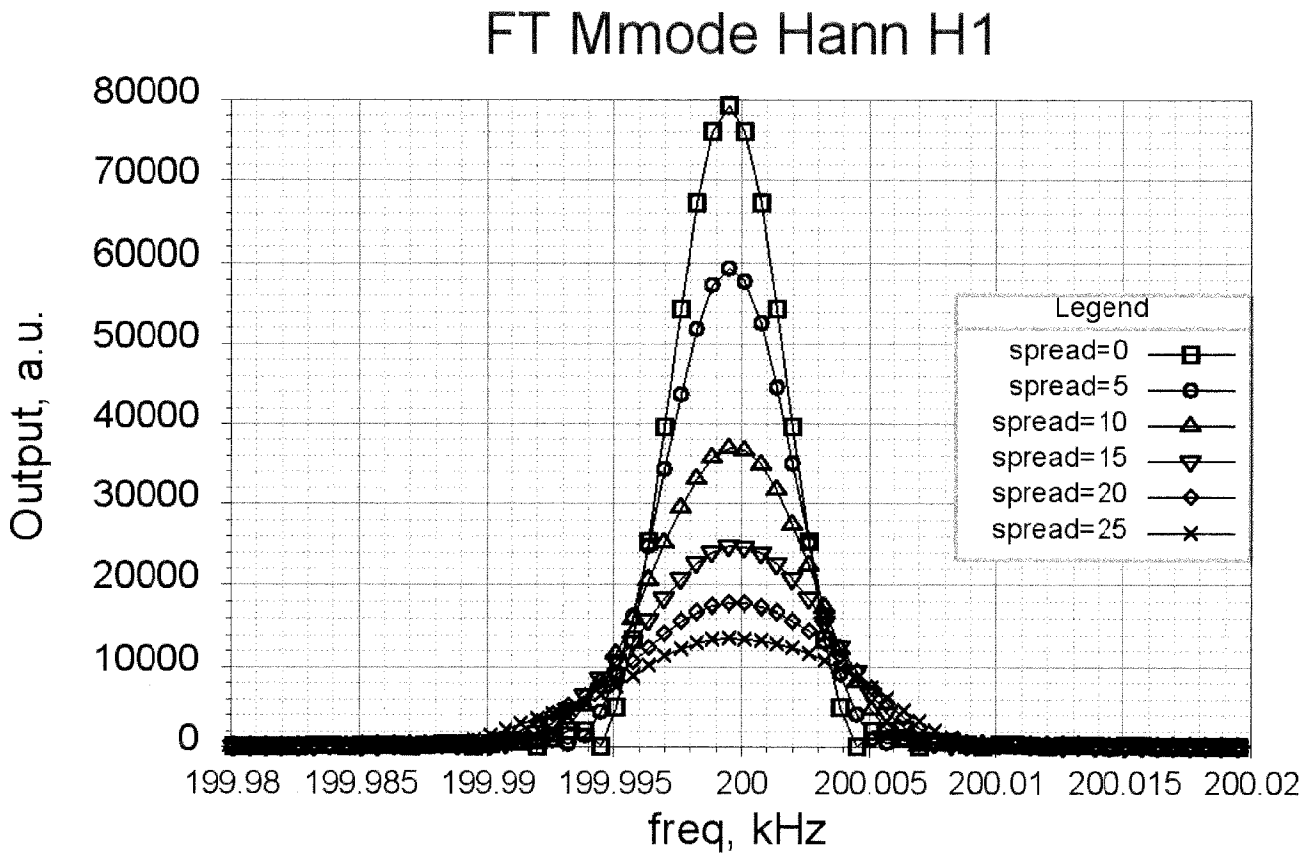
FIG. 8 shows a Fourier transform M-mode frequency spectrum generated using a full Hann window for various spread factors.

The main peak in the frequency spectrum generated by FFT for each signal is shown in FIG. 8, for an M-mode spectrum generated using full Hann window apodization.

The value of the integral, within the 199.8 kHz-200.2 kHz interval, of each peak (i.e. for each spread factor) for the spectra shown in FIG. 8 can be calculated. In other words, for each of the overlaid peaks shown in FIG. 8, the respective area under each peak is calculated by an integration method.

The integral value for each peak can be normalized relative to the integral for the peak having a zero spread factor ($\alpha=0$). This is shown in FIG. 9, where the plot line "Hann H1" (represented by squares) provides the normalized integral values for the respective overlaid peaks shown in FIG. 8.

As can be seen, we obtain different abundances of ions for different spread factors. The error reaches 77% for the first harmonic and maximal spread factor. Thus, using the M-mode with a full Hann window appears to introduce the potential for very large errors when attempting to quantify ion abundances from the spectral data.

Figure 9:
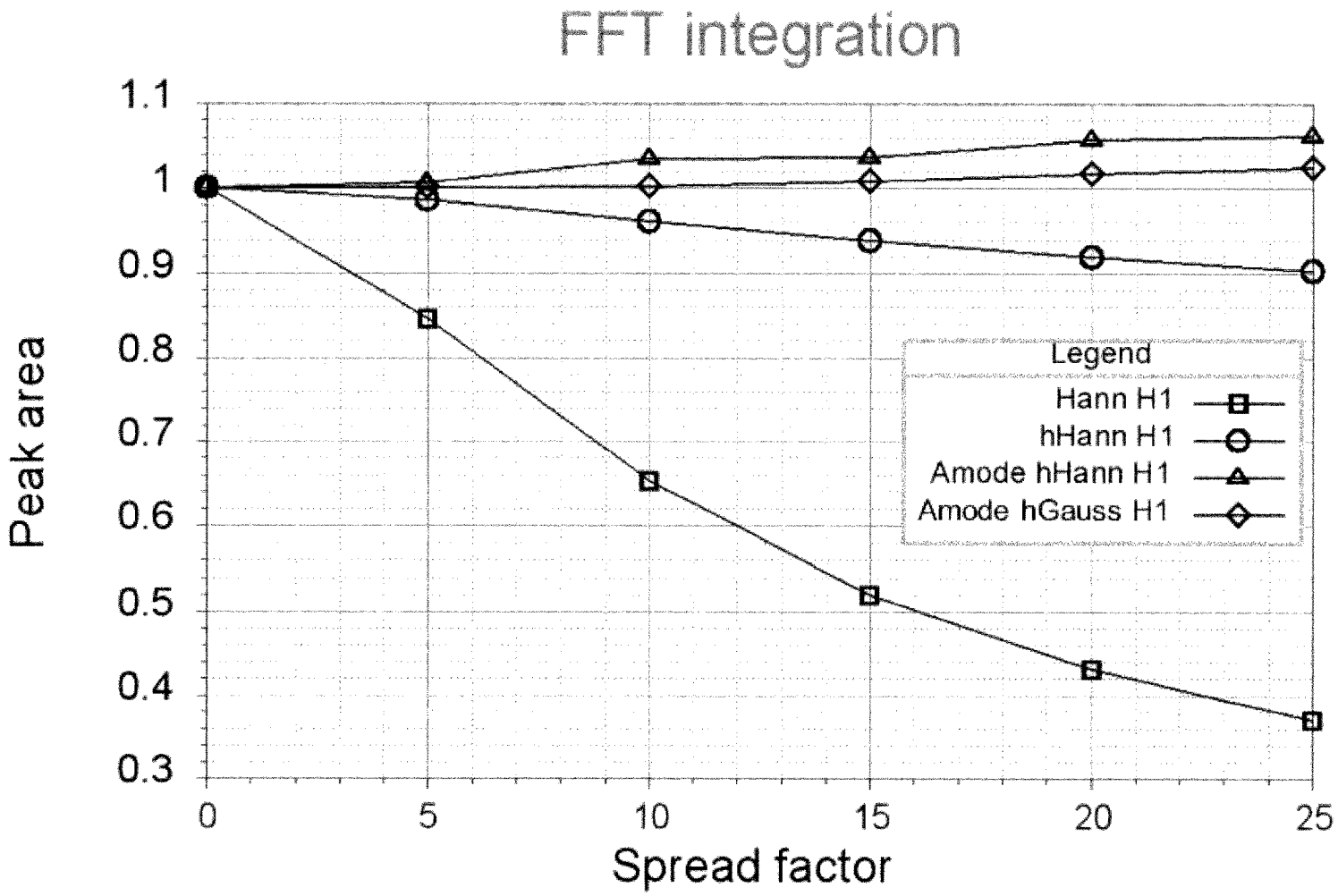
FIG. 9 shows a plot of the normalized peak area (calculated by integration) for the respective peaks shown in FIG. 8 having various spread factors, for a Fourier transform M-mode frequency spectrum generated using (i) a full Hann window function, (ii) a half Hann window, and for a Fourier transform A-mode frequency spectrum generated using (a) a half Hann window function and (b) a half Gaussian window function.

FIG. 9 also shows the result of a similar integration over the same interval but for peaks in an M-mode spectrum with half Hann apodization (plotted with circles as "hHann H1"). Here, the error is found to be 10% for the maximal spread factor. Although the result is substantially better, these types of asymmetric window (i.e. windows which don't go smoothly to zero at the beginning of the window function) are not preferable in M-mode and are not typically used because they often result in long peak tails and thus cause overlap between closely located peaks, again potentially introducing errors when attempting to quantify ion abundances from the spectral data.

Although not shown graphically here, the present inventors have also discovered that the deviation of the integral calculated for M-mode spectra remarkably increases with harmonic number which makes the deviation even worse where higher harmonics are used in analysis to get a spectrum with higher resolution.

Figure 10:
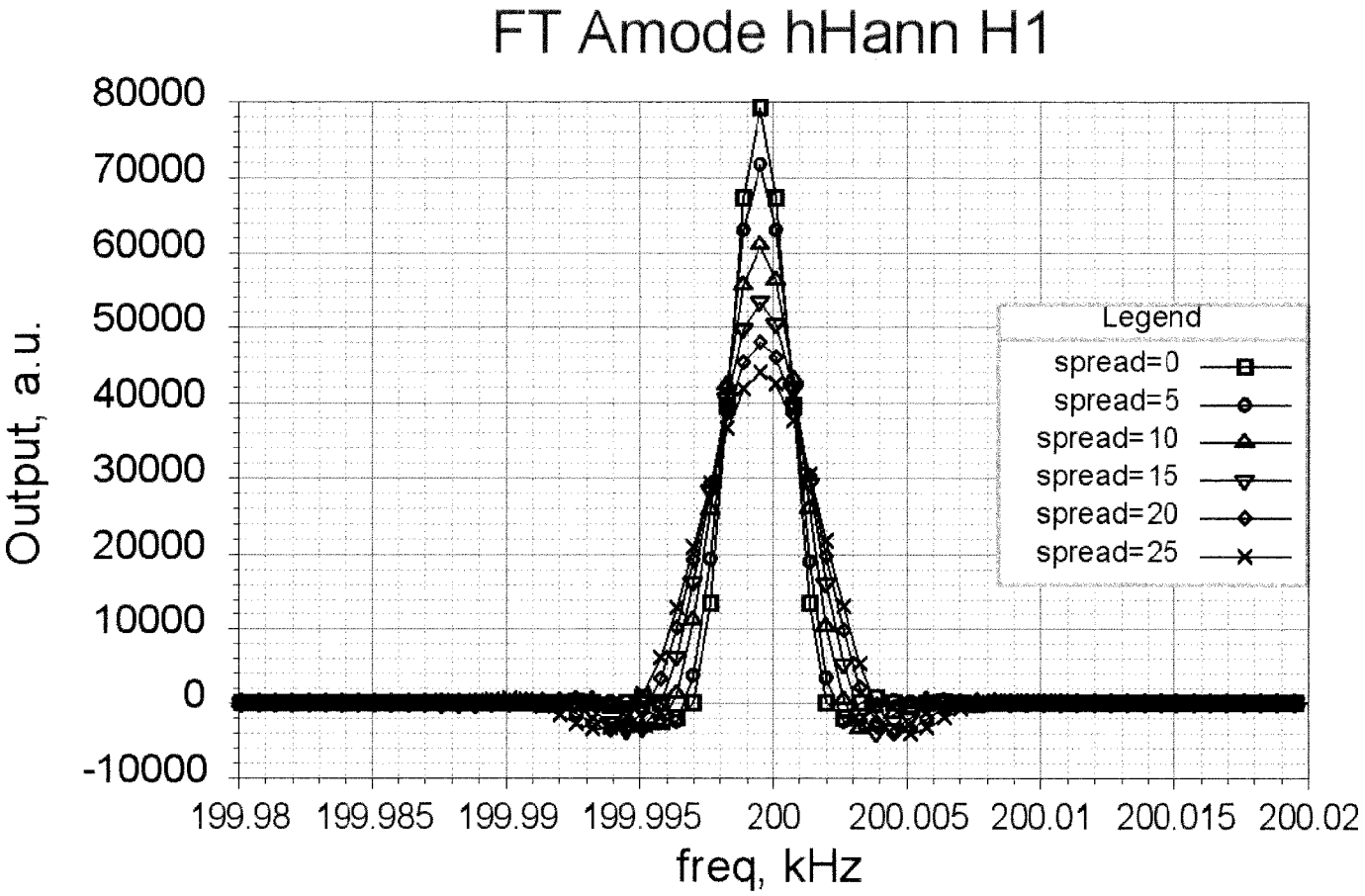
FIG. 10 shows a Fourier transform A-mode frequency spectrum generated using a half Hann window for various spread factors, in accordance with an aspect of the present invention.

FIG. 10 shows mass spectra (labelled spread=0 to spread=25) for the corresponding time-domain signals (also labelled spread=0 to spread=25) from FIG. 7 but this time processed in A-mode with half Hann window apodization. When the A-mode spectrum is used, then the normalized frequency spectrum integration will typically be a direct sum of 1000 individual signals and all points in FIG. 9 will be located at the 1.0 level (not shown in the figure), and a perfect match is made with the frequency spectrum integration for zero spread factor $\alpha=0$.

If we omit integration of negative intensities of the spectra shown in FIG. 10, then the error in the normalized frequency spectrum integration (i.e. in the quantification of the ion abundances) can reach 6% for the signal having the maximum spread factor $\alpha=25$, as shown in FIG. 9 by the plot line "Amode hHann H1". This is an improvement over the M-mode with half Hann apodization, and is much better than M-mode with full Hann window apodization.

The error can be further reduced by using a different asymmetric window for apodization, e.g. a half Gaussian window. An example of the set of peaks for various spread factors, with half Gaussian apodization is shown in FIG. 11.

Figure 11:
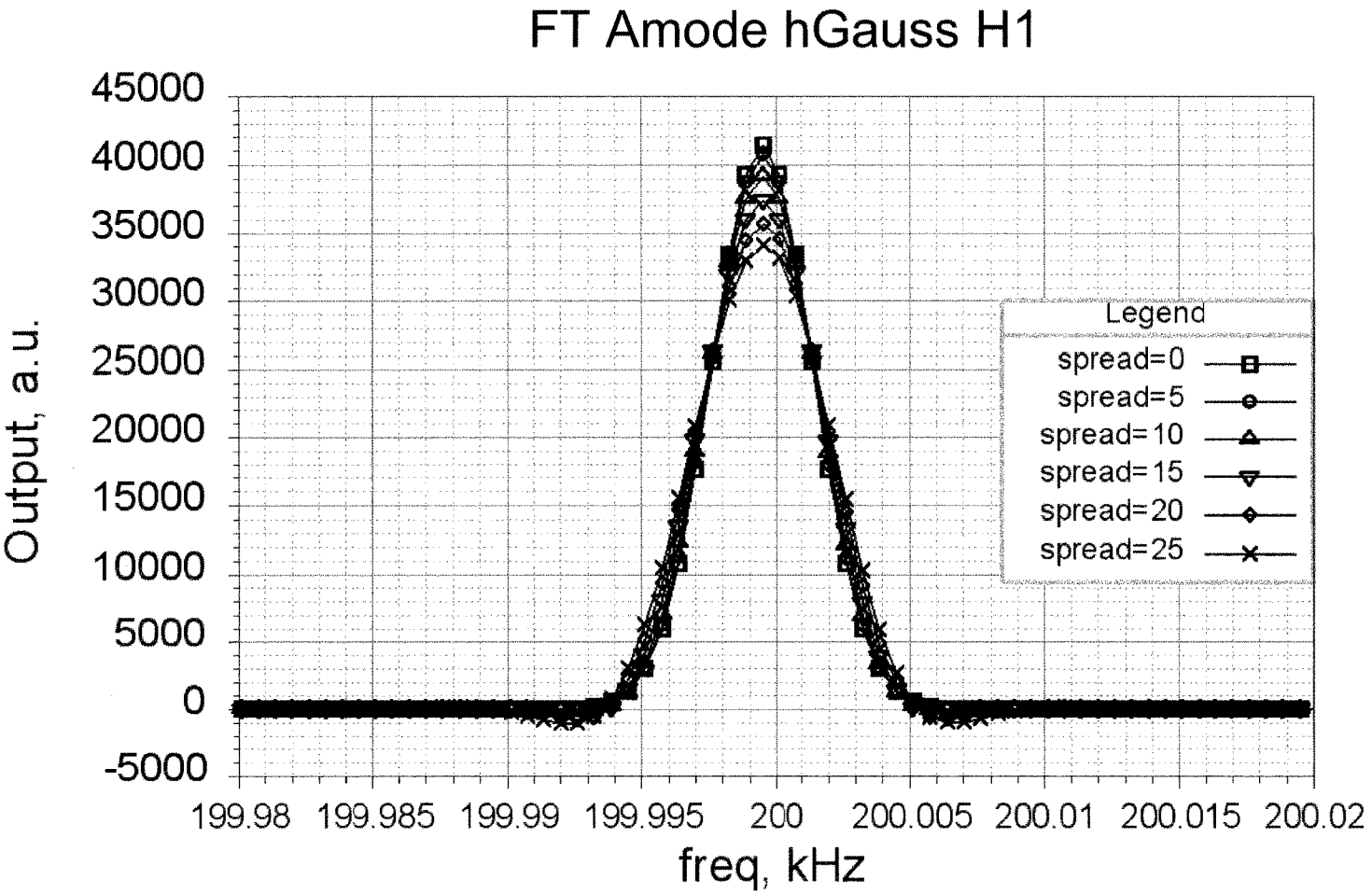
FIG. 11 shows a Fourier transform A-mode frequency spectrum generated using a half Gaussian window for various spread factors, in accordance with an aspect of the present invention.

Again, the respective normalized integration values, for the peaks in FIG. 11, are shown in FIG. 9 by the plot line "Amode hGauss H1". For these peaks, the error doesn't exceed 2% for the signal with maximal spread factor $\alpha=25$. This is because of partial discrimination of the latter part of the time domain signals, and the absence of negative overshoot in the spectra.

The signal interference used as an example above is for the ions of same mass which typically disperse due to their different initial positions or energies. However, signal interference which induces error in quantification can be caused by other reasons.

An example is when ion clouds have very close m/z values. This can be observed in the so called coalescence effect or when there are fine isotope structure pattern in the spectrum. For example, we can simulate oscillations of two ion clouds and vary the m/z (or frequency) difference between them. We can then plot the normalized total integral value, i.e. the area under the peaks, over both the peaks.

If we do this for the M-mode spectrum with full Hann window apodization, the total area drops by about a half where there is peak interference. This is shown by the plot line "M-mode" in FIG. 12.

Figure 12:
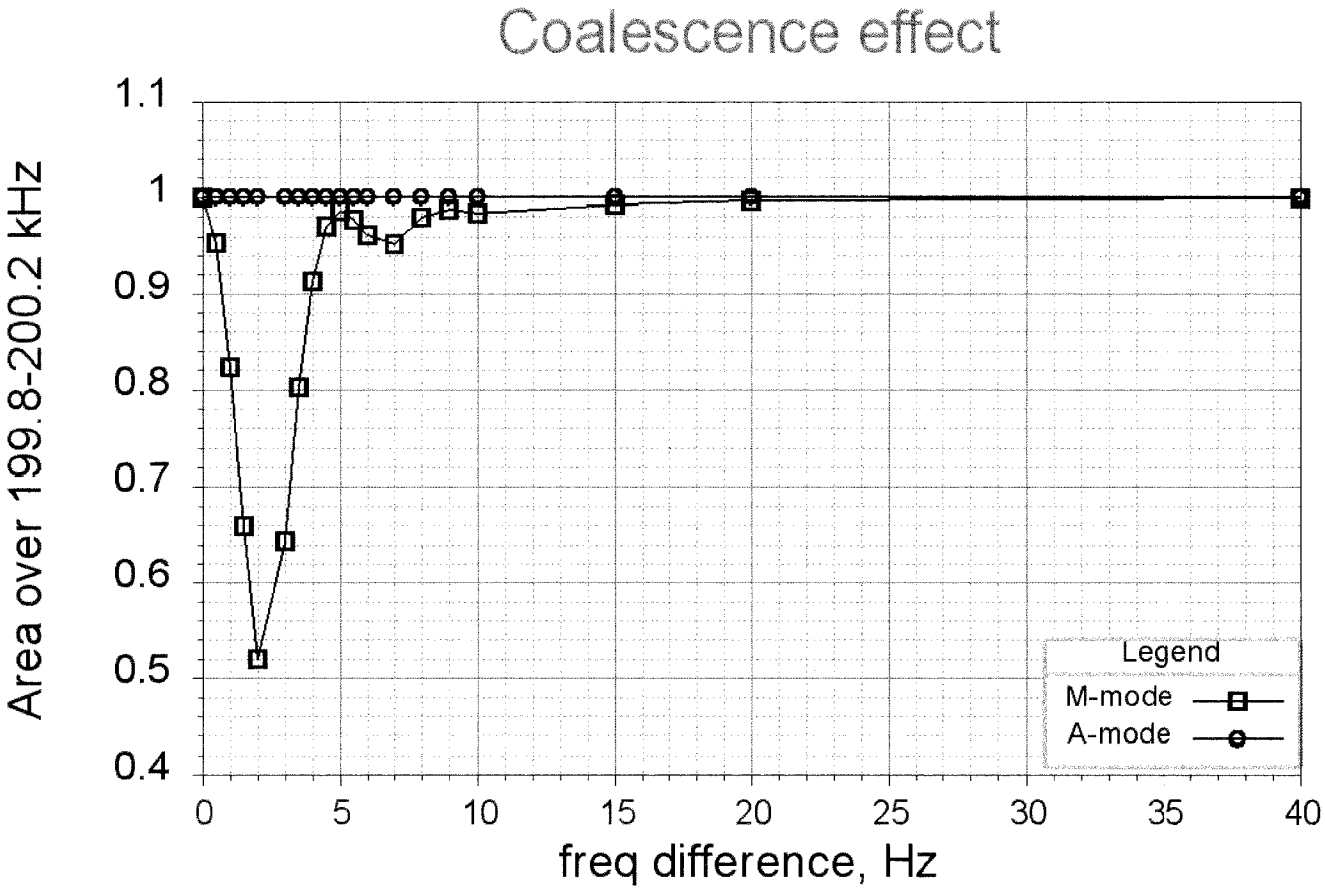
FIG. 12 shows a plot of total normalized peak intensity values for a pair of peaks as a function of the m/z (frequency) difference between them, to demonstrate the coalescence effect.

However, the total area is unaffected when the A-mode spectrum with half Hann window apodization is used, and the integration to calculate the area under the curves takes the negative intensities into account. Again, this is shown in FIG. 12 by plot line A-mode.

Further Correction by a Calibration Factor

Sometimes even the method described above provides results which include unacceptable errors, as explained in more detail below, and thus requires some correction in the form of a calibration factor.

For example, for a given ion injection and trapping field parameters, the spatial (consequently the frequency) final spread of an ion cloud of a certain mass depends on the number of ions in the cloud, and on the acquisition time. This is problematic because the above discussed additive nature of A-mode spectra may not be conserved if the charge interaction between ions become too severe. This might happen when the Coulomb repulsion between ions causes ions to leave a stable trajectory and hit the electrode of the ion trap and be lost for example. Another example is when it is necessary to excise a negative part of the peaks (which contribution depends on the number of ions), when doing integration.

The ion motion may also drift from its original phase angle due to the space charge interaction.

These lost or phase drifted ions contribute a time signal that is different from the signal generated by the same ion as it flies alone.

If the additive nature of the A-mode is not conserved, then the peak intensities will no longer linearly increase with the number of ions, and may not provide an accurate indication of the number of ions. This nonlinearly of response will only start when the peak intensity reaches a quite high level where space charge interaction takes places.

So, the present inventors propose the optional introduction of a calibration factor f to account for this potential problem, whereby the corrected value of the peak intensity $A_{corrected}$ for a peak can be calculated as:

$$A_{corrected}=A/f$$

where A is the peak intensity of peak(s) as a result of integration within pre-determined frequency range as described above.

Indeed, for any chosen m/z value a calibration function $f(A,T_d)$, which can be thought of as a 2D surface, can be generated on the basis of previously measured results (taken during a calibration or control process) for a plurality of calibration factors associating various acquisition times $T_d$ and the corresponding peak intensities of the relevant peaks.

Subsequently, when this calibration function $f(A,T_d)$ is used to correct a peak intensity, interpolation may be used to find the appropriate calibration factor at a desired point $(A,T_d)$ from the calibration function $f(A, T_d)$. In other words, interpolation may be used to find the appropriate calibration factor corresponding to a particular association of peak intensity and acquisition time within 2D surface provided by the calibration function.

For a particular detection time $T_d$ (and other conditions), the calibration function provides a calibration factor which can be defined as f(A)=A/N where A is the peak intensity (in particular, the peak area, e.g. obtained by integrating the area under peak) at a certain $m_i/z_i$ in the mass spectrum, and N is the number of injected ions within that peak range.

N is determined during a calibration process, as discussed below.

The calibration factor f(A) can be used in the conditions when an ion cloud spread is not affected by other ion clouds interaction, i.e. until a certain $N_{max}$ (or corresponded $A_{max}$) value.

As a result, the correct peak area can be calculated as $N_{corrected}=A_{measured}/f(A_{measured})$, thereby yielding a highly accurate (quantitative) value for the number of ions at the particular m/z value.

The calibration factor f(A) is unique for a given ion trap field configuration, injection conditions, harmonic order used for mass spectrum deconvolution, m/z value and detection time, $T_d$.

The generated calibration function can also be used to correct the peak intensities of ions other than ions used to generate the calibration factor. For example, consider ions with another different $(m/z)_0$ value to that used to generate the calibration function, its equation of motion and therefore its trajectory path is completely identical to the ions of chosen (m/z) if we rescale time axis as $$t \rightarrow \sqrt{\frac{(m/z)_0}{(m/z)}}\, t$$

This means that if our original ions of m/z value gained a certain spatial spread at $T_d$ time then mass $(m/z)_0$ would gain same spread at the moment in time $$T_{d0} = \sqrt{\frac{(m/z)_0}{(m/z)}}\, T_d$$

This statement is valid only if we consider (m/z) and $(m/z)_0$ ion clouds having same charge number z. Thus, we must use a calibration factor for another $(m/z)_0$ value based on the calibration function measured for the original m/z value at the point $(A,T_d)$ where $T_d$ is calculated as $$T_d = \sqrt{\frac{(m/z)}{(m/z)_0}}\, T_{d0}$$

In this way, the calibration function $f(A,T_d)$ generated for a particular m/z calibrant can be used for any other $(m/z)_0$.

Alternatively, interpolation of calibration factors preliminary measured for a set of m/z values can be used to find the factor for a certain $(m/z)_0$ value. In this case it is preferable to use constant $T_{d0}$ value to get f(A,m/z) 2D surface which then is used for a desired $(m/z)_0$ value which signal acquisition time is also equals to $T_{d0}$. In particular, this is important when m/z and $(m/z)_0$ ion clouds motion is not identical even though time axis is stretched using time rescaling formula as discussed above.

It is possible to use higher harmonic peaks in the spectrum (compared to the fundamental or the first harmonic) for quantification and this is particular important for ion traps that generate image charge signals containing high harmonics. If different harmonics are used to analyse a frequency (mass) spectrum then the calibration function $f(A,T_d)$ should be generated for each relevant harmonic individually. The same algorithm as described above is to be applied, and peak intensity of the same harmonic have to be used both in calibration process and data acquisition process.

Example Procedure

The calibration function (or correction function) can be determined as follows, for example to be used to eliminate the errors related to space-charge interaction. The following discussion is made with reference to FIG. 1.

Initially, ions are formed from a solution containing a calibrant in ion source 1, and through the system of lenses 3 the ions are directed to RF quadrupole trap 5 for collisional cooling with buffer gas inside trapping region 7.

During cooling, a DC component is superimposed over an RF voltage applied to quadrupole electrodes so as to isolate ions with masses corresponded to a singly charged calibrant.

After cooling and mass selection, the ions are ejected from region 7 through orifice 9, ion guide 11 and a slit provided in curved ion guide 13 to a detector 15 which detects the number of ions in the cloud and provides a signal indicative of the number of detected ions, N. Typically, the detector 15 is an electron multiplier for example. Typically, the ion cloud is not reusable after detection of the number of ions by the detector 15.

Therefore, (before or) after detection of the number of ions N, another ion cloud is generated on the basis of precisely the same starting conditions (e.g. ion flux from ion source 1, accumulation time inside trapping region 7, mass selection window). But, after passing the ion guide 11, the ions are directed to travel inside ion guide 13 instead of detector 15. For example, they are injected inside ion trap 17 by means of dropping gate voltage on the radially inner side of ion guide 13.

After the ions are injected inside ion trap 17 the gate voltage is restored without changing total energy of the ion cloud 19.

The image charge (transient) signal is detected on the pick-up electrodes one of which (indicated by reference numeral 21) is shown in FIG. 1.

The ion cloud oscillates during maximal detection time $T_{d\ max}$ allowing the transient signal to be detected.

The measured transient signal is converted to a mass spectrum by means of a digital Fourier Transform (e.g. by a FFT), and the peak intensity A at the m/z corresponding to the calibrant ion mass is recorded. Again, the transform is performed by applying an appropriate (e.g. asymmetric) window function to give minimal negative overshoot for peaks in the mass spectrum.

Preferably, the mass spectrum is an A-mode spectrum, and thus a phase correction is performed with a phase function predetermined at exactly the same injection conditions and electrical field configuration. For example, the phase function is preferably measured for several m/z calibrants in order to get a reasonable number of points to interpolate the phase function at any m/z value.

Analysis of part of the transient signal for different ending detecting times $T_d$ up to the maximal detecting time $T_{d\ max}$ can be performed to obtain a dependence of the peak intensity A on the detection time $T_d$.

The whole procedure (detection of N and transient signal recording) is repeated with a variation of N within [$N_{min}$; $N_{max}$] range to obtain a two dimensional dependence of the peak intensity $A(N,T_d)$. Preferably, the lower range limit $N_{min}$ is chosen so that the measured signal is barely detectable above background noise. Preferably, the upper range limit $N_{max}$ is chosen so that there is a significant space charge interaction within the calibrant ion sample in the ion trap during the procedure.

The calibration (or correction) function $f(A,T_d)$ is calculated using these data as follows:

$f(A,T_d)=A/N$ which is valid for $m/z$ values corresponding to the calibrant used.

Having established the calibration function for a range of N values, and for a range of acquisition times $T_d$, the calibration function can be used to correct the measured intensities of peaks presenting abundances of various m/z values in another routine mass-spectrum acquired by means of the same or similar electrostatic ion traps. This is mentioned briefly above, and is discussed in more detail below.

The correction is most effective when the decay rates of various ion clouds depend principally on pure space charge repulsion effects, and when there is no significant influence of other ion clouds on the ion cloud under consideration.

The former condition is valid if the vacuum level inside ion trap analyser is good enough to neglect the impact of collisions with the background gas molecules on the ion cloud spatial spread during detection time.

The latter condition is valid if the maximal intensity in the mass spectrum corresponds to number of ions less than $N_{max}$ at which the influence of space charge of this ion cloud on the spatial spread of ion cloud under consideration cannot generally be neglected.

Applying the Calibration Factor

As explained above, having generated the calibration function by the method described herein, the calibration function can also be used to provide a suitable calibration factor to adjust, or correct, the peak intensity measured for any $m'/z$, even though the calibration function itself is originally generated for a particular m/z which is different to $m'/z$.

For example, the calibration factor may be generated for a particular calibrant mass $m_1$. However, as discussed above, not only are ion clouds of various numbers N of mass $m_1$ analysed to generate the calibration factor, but also various acquisition times $T_d$ are used too to generate a calibration function which is effectively a 2D matrix (A vs $T_d$) providing a respective calibration factor for each intersection of A and $T_d$.

Therefore, when a real ion sample is used, and the corresponding mass spectrum is generated, then it is possible to correct the peak intensity for a peak at a particular $m_2/z$ for a mass $m_2$ which is different to the calibrant mass $m_1$, and which was acquired with a known acquisition time of $T_{dm2}$.

The mass $m_2$ is not the same as the calibrant mass (which we can refer to as $m_1$). Therefore, we cannot simply choose the calibration factor (to use for adjusting or correcting the peak intensity for $m_2/z$) based directly on the acquisition time $T_{dm2}$ for acquiring the $m_2/z$ value from the calibration function $f(A, T_d)$ generated for the calibrant mass $m_1$. In other words, we cannot simply choose the appropriate calibration factor on the basis that $T_{dm2}=T_{dm1}$.

Rather, we must choose the calibration factor on the basis of the following relationship between the acquisition times $T_{dm1}$ and $T_{dm2}$ respectively for m1 and m2 ion clouds performing the same number of oscillations:

$$T_{dm2}/T_{dm1}=\mathrm{sqrt}(m_2/m_1)$$

So, we must choose the calibration factor from our 2D matrix of calibration factors provided by the calibration function on the basis that $$T_{dm1}=\mathrm{sqrt}(m_1/m_2)*T_{dm2}$$

Therefore, the intensity of the peak associated with ion mass $m_2$ can be corrected or adjusted accordingly, to provide a quantitative value for the number of ions at $m_2/z$.

$$N_{corrected}=A_{measured}/f(A_{measured},\mathrm{sqrt}(m_1/m_2)*T_{dm2})$$

where detection time $T_{dm2}$ is the detection time used for ions with $m_2/z$ values, and where $m_1$ is the mass of the calibrant ions used during the above described calibration function generation.

Accordingly, by applying in this way the calibration function to the measured peaks in the spectrum under investigation, an accurate quantitative value for the number of ions at $m_2/z$ acquired over a time $T_{dm2}$ is achievable even though the calibration function was originally determined for a calibrant mass $m_1$ which is different to m2.

Naturally, because the calibration function $f(A, T_d)$ effectively provides a 2D surface or 2D matrix, if the value of $\mathrm{sqrt}(m_1/m_2)*T_{dm2}$ does not match precisely with a measured value for $T_{dm1}$ during the calibration process, then interpolation can be used to provide a suitable calibration factor. Likewise, if the $A_{measured}$ (measured peak intensity) does not match precisely with a peak intensity measured during the calibration process then interpolation can be used to provide a suitable calibration factor.

General Statements

According to an aspect of the present invention, by applying a suitable asymmetric window function to the time domain data prior to the transformation to an A-mode mass spectrum in the frequency domain, mutual peak interference can be reduced and the relative peak intensities in the spectrum more accurately reflect the ion abundances in the ion sample.

According to a preferred refinement of the present invention, by applying a calibration function to the generated spectrum (A-mode, for example, but also M-mode or power mode) the ion abundances represented by the respective peaks in the spectrum can be made even more accurate. Indeed, suitable application of the calibration factor to an A-mode spectrum generated in accordance with the teaching herein yields an accurate quantitative value for the number of ions associated with a particular peak in the spectrum.

Throughout this application, the terms mass spectrum and frequency spectrum are used interchangeably because they represent equivalent spectra.

The calibration factor may be obtained by: producing a series of calibration ion groups and injecting one ion group at a time into an ion trap and carrying out image charge signal acquisition for each group; determining the number of ions for each group of ions injected in the ion trap; converting the time domain image charge signal to the absorption mode mass spectrum and measure the integral of the peak associated with the mass to charge ratio of the calibration group; finishing all ion groups test and obtaining the relation between the peak integral per ion and the peak integral and forming the calibration function; and output the calibration factor according to the measured integral of each peak.

The ion number in said calibration ion groups preferably cover a wide range from the level that gives signal distinguishable from background noise to the level causing significant space charge interaction inside the ion trap.

The number of ions in each ion group is preferably measured using a particle detector based on electron multiplier.

The calibration function is preferably measured for a set of acquisition times $T_d$ to provide a two-dimensional dependence $f(A,T_d)$.

The invention claimed is:

1. A method of quantification of one or more ion species, in a sample of ions, using a mass spectrometer, the method including the steps of:

obtaining a time domain data set corresponding to a signal induced by motion of the ions in the mass spectrometer;

adjusting the data set by applying an asymmetric window function thereto, wherein the asymmetric window function is selected to reduce negative side peaks in the absorption mode spectrum;

generating an absorption mode mass spectrum in the frequency domain including the step of applying a Fourier transform to the adjusted data set;

determining peak ranges for one or more peaks in the mass spectrum associated with the one or more ion species;

integrating, for each determined peak range, the spectral data within the respective peak range to generate a respective peak intensity value; and quantifying each of the one or more ion species on the basis of the respective peak intensity values.

2. A method as claimed in claim 1, wherein the asymmetric window function is selected to suppress later data relative to earlier data in the time domain data set.

3. A method as claimed in claim 1, wherein the asymmetric window function is selected to minimize negative side peaks in the absorption mode spectrum.

4. A method as claimed in claim 1, wherein the asymmetric window function includes a shifted Gaussian window function or a shifted Hann window function.

5. A method as claimed in claim 1, wherein the step of generating the absorption mode mass spectrum includes applying a phase correction to the complex frequency spectrum using a predetermined phase-frequency relation.

6. A method as claimed in claim 1, wherein said integration of the spectral data within each respective peak range includes calculating the peak area within the respective peak range.

7. A method as claimed in claim 1, wherein a peak range is defined to be between two first zero crossing points of the spectral curve of the spectrum, each of the two first zero crossing points being located on a respective side of the respective peak.

8. A method as claimed in claim 1, further including the step of applying a calibration function to correct each generated peak intensityvalue, and wherein the step of quantifying each of the one or more ions species is performed on the basis of the corrected intensity value.

9. A method according to claim 8 wherein the calibration function is obtained by performing a calibration process including the steps of:

generating a series of respective calibration ion species of respectively different ion numbers;

determining the number of ions in each respective calibration ion species using a particle detector;

acquiring for each calibration ion species a respective time domain calibration data set corresponding to detected relative motion of the respective calibration ion species;

adjusting each calibration data set by applying the asymmetric window function thereto;

generating, for each calibration ion species, a respective absorption-mode mass spectrum in the frequency domain by applying a Fourier transform to the respective adjusted calibration data set;

determining a peak range for each peak in the mass spectrum associated with the respective calibrant ion species;

integrating, for each determined peak range, the spectral data within the respective peak range to generate a respective peak intensity value for the respective calibrant ion species; and determining the relation between the peak intensity value per ion and the peak intensity value to generate the calibration function for the respective calibrant ion species.

10. A method according to claim 9, wherein the acquisition step is repeated for a series of respectively different acquisition times.

11. A method according to claim 1, wherein time domain data set is obtained by a measurement process comprising the steps of:

generating the ion sample comprising a plurality of ions;

injecting the ion sample to an ion trap and controlling the ions to perform oscillating motion in the ion trap;

generating the time domain data set by detecting the image charge signals induced by the motion of ions.

12. A computer program which, when run on a computer, executes the method of claim 1.

13. A computer readable medium having stored thereon a computer program which, when run on a computer, executes the method of claim 1.

14. An ion trap mass spectrometer including:

a detector for detecting the motion of ions in the mass spectrometer, and for outputting a signal indicative of the motion of the ions; and a computer arranged:

to obtain a time domain data set corresponding to the output signal;

to adjust the data set by applying an asymmetric window function thereto, wherein the asymmetric window function is selected to reduce negative side peaks in the absorption mode spectrum;

to generate an absorption mode mass spectrum in the frequency domain by applying a Fourier transform to the adjusted data set;

to determine peak ranges for one or more peaks in the mass spectrum associated with the one or more ion species;

to integrate, for each determined peak range, the spectral data within the respective peak range to generate a respective peak intensity value; and to quantify each of the one or more ion species on the basis of the respective peak intensity values.

15. A electrostatic ion trap mass spectrometer according to claim 14.

* * * * *